US007183024B2

(12) United States Patent
Roberts et al.

(10) Patent No.: US 7,183,024 B2
(45) Date of Patent: Feb. 27, 2007

(54) HIGH-SPEED POSITIVE-WORKING PHOTOTHERMOGRAPHIC SYSTEM

(75) Inventors: Michael R. Roberts, Rochester, NY (US); Paul B. Gilman, Penfield, NY (US); Donald L. Black, Webster, NY (US); Kurt M. Schroeder, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/460,129

(22) Filed: Jun. 12, 2003

(65) Prior Publication Data

US 2004/0259041 A1 Dec. 23, 2004

(51) Int. Cl.
*G03C 5/16* (2006.01)
*G03C 11/00* (2006.01)

(52) U.S. Cl. ..... 430/21; 430/350; 430/611; 430/619; 430/620; 430/955; 430/957; 430/964; 430/966

(58) Field of Classification Search ..... 430/619, 430/620, 350, 21, 966, 955, 957, 567, 611, 430/964
See application file for complete search history.

(56) References Cited

U.S. PATENT DOCUMENTS

| | | | | |
|---|---|---|---|---|
| 3,655,390 | A | 4/1972 | Overman | |
| 3,700,457 | A * | 10/1972 | Youngquist | 430/352 |
| 4,186,009 | A * | 1/1980 | Jones | 430/353 |
| 4,426,441 | A * | 1/1984 | Adin et al. | 430/351 |
| 4,504,568 | A * | 3/1985 | Clark et al. | 430/203 |
| 4,629,640 | A * | 12/1986 | Akao | 428/35.3 |
| 5,677,121 | A * | 10/1997 | Tsuzuki | 430/619 |
| 6,060,231 | A * | 5/2000 | Zou | 430/619 |
| 6,312,879 | B1 * | 11/2001 | Slusarek et al. | 430/467 |
| 6,369,873 | B1 * | 4/2002 | Levy et al. | 355/27 |
| 6,394,649 | B1 | 5/2002 | Moore et al. | |
| 6,495,299 | B2 | 12/2002 | Levy et al. | |
| 6,573,033 | B1 | 6/2003 | Simpson et al. | |
| 2002/0015928 | A1 * | 2/2002 | Irving et al. | 430/620 |
| 2002/0102502 | A1 * | 8/2002 | Fukui et al. | 430/350 |

FOREIGN PATENT DOCUMENTS

| | | | |
|---|---|---|---|
| GB | 1507829 | * | 4/1978 |
| GB | 2 018 453 A | | 4/1979 |

* cited by examiner

*Primary Examiner*—Thorl Chea
(74) *Attorney, Agent, or Firm*—Chris P. Konkol

(57) ABSTRACT

The present invention is directed to a method of forming a positive image in a photothermographic element comprising a potentially negative-working emulsion wherein fog density development is imagewise inhibited in exposed areas of the image upon thermal development. In one embodiment of the invention, a density-inhibiting agent is released during thermal development which agent inhibits the thermal development of unexposed silver salts in the exposed areas relative to the unexposed areas. The method preferably comprises imagewise exposing the film with a non-solarizing amount of radiation/energy to form a latent image and thermally developing the latent image in a single development step to produce a positive image in the element. The present invention is also directed to a photothermographic element that can be used in the present process in which a positive image characterized by high speed and discrimination is formed when exposed and thermally heated above 150° C.

29 Claims, 2 Drawing Sheets

HIGH-SPEED POSITIVE-WORKING PHOTOTHERMOGRAPHIC SYSTEM

FIELD OF THE INVENTION

This invention relates to a positive-working silver-halide photothermographic system, including a photothermographic element that is capable of high speed and a process of making an image employing such elements.

BACKGROUND OF THE INVENTION

In conventional photography, films containing light-sensitive silver-halide grains are employed in a number of image recording devices including but not limited to a variety of consumer cameras, x-ray imaging cassettes, dental film packets, dosimeters, and microscopy imaging systems. Upon exposure, the film produces a latent image that is only revealed after suitable processing. These film elements have historically been processed by treating the exposed film with at least a developing solution having a developing agent that acts to form an image in cooperation with other components in the film.

It is always desirable to limit the amount of solvent or processing chemicals used in the processing of silver-halide films. A traditional photographic processing scheme for black-and-white film involves development, fixing and washing, each step typically involving immersion in a tank holding the necessary chemical solution. By scanning the film following development, the subsequent processing solutions could be eliminated for the purposes of obtaining a positive image. Instead the scanned image could be used to directly provide the positive image.

By the use of photothermographic film, it is possible to eliminate processing solutions altogether, or alternatively, to minimize the amount of processing solutions and the complex chemicals contained therein. A photothermographic (PTG) film by definition is a film that requires energy, typically heat, to effectuate development. A dry photothermographic film requires only heat. A solution-minimized photothermographic film may require small amounts of aqueous alkaline solution to effectuate development, which amounts may only be that required to swell the film without excess solution. Development is the process whereby silver ion is reduced to metallic silver and in a color system, a dye is created in an image-wise fashion. In many photothermographic films, the silver is typically retained in the coating after the heat development.

In photothermographic films employing what is referred to as "dry physical development," a photosensitive catalyst is generally a photographic-type photosensitive silver halide that is considered to be in catalytic proximity to a non-photosensitive source of reducible silver ions. Catalytic proximity requires intimate physical association of these two components either prior to or during the thermal image development process so that when silver atoms, $(Ag^o)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms (Klosterboer, Neblette's Eighth Edition: *Imaging Processes and Materials*, Sturge, Walworth & Shepp (eds.), Van Nostrand-Reinhold, New York, Chapter 9, pages 279–291, 1989). It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). The non-photo-sensitive source of reducible silver ions is typically a material that contains reducible silver ions and preferably a silver salt of an organic compound.

Photothermographic (PTG) media employing dry physical development are formulated with one or more light sensitive imaging layers on a light transmitting or reflecting support. Each imaging layer typically has at least one light-sensitive silver-halide emulsion, a reducible non-light-sensitive silver salt, a developer or developer precursor, and optionally a coupler to form dye. Other components may include accelerators, toners, binders, and antifoggants known in the trade as well as components used in conventional solution-processed silver-halide photographic media.

When exposed to light and then heated at temperatures ranging from 100 to 200° C. for 5 to 60 seconds, photothermographic media develop densities varying with exposure. The density versus log exposure curve (H&D curve) is commonly used in the trade to compare parameters such as speed and contrast. A typical procedure entails making a contact exposure through a step tablet image. The steps modulate the intensity of the incident light, usually in 0.10 to 0.30 log exposure increments. Another method entails exposing pixel-wise using a laser, CRT or LED source in which the exposure intensity is modulated electronically. The exposed media is then thermally developed. The measured reflection or transmission density of each step is then plotted against relative or absolute log exposure to produce what is known in the industry as the "H&D curve." H&D curves typically have two plateaus corresponding to the maximum density (Dmax) and minimum density (Dmin) where the slope of the H&D curve approaches or equals zero; that is, a change in exposure produces little or no change in measured density. Gamma refers to the slope of the H&D curve usually at some fixed density position. Point gamma refers to the change in density between two adjacent exposure positions in a plot of the H&D values. For purposes of this invention, the mid-scale density refers to the density midway between Dmax and Dmin plateaus, or (Dmax-Dmin)/2. The corresponding exposure is designated the midscale exposure.

As used herein with respect to the present invention, the term "negative-working" refers to a photographic silver-halide emulsion that develops more density with increasing exposure up to the Dmax limit when an imagewise-exposed gelatin coating of the emulsion is processed using a solution—development process and concomitant materials in accordance with the well-known and conventional D-76 standard. The corresponding H&D curve has a positive slope in the mid-scale density range when density is plotted against increasing relative log exposure. The unexposed areas develop to Dmin. The image produced in this way is referred to as a "negative image." It is to be understood that the term "negative-working emulsion" as used herein is synonymous with "potentially negative-working emulsion" and refers to an inherent capability of the emulsion that may or may not be realized in practice.

A "positive-working" photographic silver-halide emulsion, as used herein with respect to the present invention, responds to exposure by developing less density with increasing exposure down to the saturation limit (Dmin) when an imagewise-exposed gelatin coating of the emulsion is processed using a solution-development process and materials in accordance to the well-known D-76 standard. In this case, the H&D curve has a negative slope in the mid-scale density region when density is plotted against increasing relative log exposure. The unexposed areas develop to Dmax. The image produced in this way is referred to as a "positive image."

Materials, including solution developers, qualifying for commercially acceptable use in a D-76 standard process include Kodak's trademarked products designed for such a process. See G. Haist, "Modern Photographic Processing, Vol 1", John Wiley & Sons, Chapter 7, p 340 (1979) for the preparation of D-76 developer and other related developer formulas, the disclosure of which is hereby incorporated by reference. D-76 developer, therefore, includes any or all materials designated for and commercially used, with commercially satisfactory results in a D-76 process. Preferably, the D-76 developer is a Kodak product or one that is substantially equivalent in practice.

In a positive-working or negative-working emulsion, the developed density can comprise either silver, or if the imaging layer also contains a dye-forming coupler to react with oxidized developer, silver plus dye.

In the case of conventional solution-processed photographic media, as compared to dry or apparently dry thermally developed photothermographic media, positive images can be obtained from negative-working emulsions using combinations of multiple exposures and/or multiple development steps. See G. Haist, cited above, for details on black-and-white and color reversal-development processes, in which the following patents are cited: U.S. Pat. No. 2,005,837, U.S. Pat. No. 2,126,516, U.S. Pat. No. 2,184,013, U.S. Pat. No. 2,699,515, U.S. Pat. No. 3,361,564, U.S. Pat. No. 3,367,778, U.S. Pat. Nos. 3,455,235, 3,501,310, U.S. Pat. No. 3,519,428, U.S. Pat. No. 3,560,213, U.S. Pat. No. 3,579,345, U.S. Pat. No. 3,650,758, U.S. Pat. No. 3,655,390, BR 44,248, BR 1151782, BR 1155404, BR 1186711, BR 1201792, CA 872180, and CA 872181.

For example, photobleach emulsions can be used in conventional solution-developed silver-halide photographic media to produce positive images. These emulsions are prepared with desensitizing dyes and chemical fogging agents. An exposure destroys preformed surface fog centers rendering the grains undevelopable. The unexposed grains develop to form a positive image. G. Haist reviews this topic in *Modern Photographic Processing*, Vol 2, Chapter 7, John Wiley & Sons, (copyright 1979).

GB 2018453A to Willis et al. teaches a photothermographic element comprising resorcinolic coupler, phenylenediamine developer, gelatin, silver bromoiodide emulsion (negative-working), various reducible organic silver salts (notably the silver salt of 3-amino-5-benzylthio-1,2,4-triazole (ABT)), and an antifoggant 3-methyl-5-mercapto-1,2,4-triazole (MMT). Slusarek et al., in U.S. Pat. No. 6,319,640 and U.S. Pat No. 6,312,879, describes blocked phenylenediamine developers for photothermographic media coated from water and gelatin.

A problem with photothermographic elements has been obtaining high photographic speeds. Silver-halide emulsions that are optimally sensitized for photographic speed in aqueous gelatin generally lose speed in contact with organic solvents and non-gelatin binders that are used in many non-aqueous photothermographic systems. Organic solvents may induce dye desorption, dye deaggregation, or some other chemical effect that degrades photographic efficiency. Methods of chemical and spectral sensitizations in organic solvents are less effective than in water for similar reasons.

Gelatin coatings, on the other hand, are more difficult to thermally develop due to the physical properties of the gelatin when it is heated. Lower developed density and photographic speed generally result from the higher glass transition temperature of gelatin and generally slower rates of diffusion of developer components in the strong hydrogen bonding polypeptide matrix. Gelatin coatings also require dispersing the incorporated water-insoluble developer components, which causes them to react generally more sluggishly under thermal processing conditions compared to organic solvent coatings in which developer components are dissolved in the coating solvent.

In addition, all of the prior art describes photothermographic systems that produce negative images that are nearly equal in speed to those obtained with solution development. In contrast, the present invention can produce direct-positive photographic speeds that are two to three stops greater than speeds obtained by solution or thermal development of same-size negative-working silver-halide emulsions.

SUMMARY OF THE INVENTION

The present invention is directed to a method of forming a positive image in a photothermographic element comprising a potentially negative-working emulsion wherein fog density development is imagewise inhibited in exposed areas of the image upon thermal development. By "fog density" is meant the thermal development, in the emulsion, of unexposed silver particles, whether light-sensitive and/or non-light sensitive silver-containing particles. The image can be monochrome or bichrome. The photographic element is useful in various contexts, including use as film in cameras such as reloadable or one-time-use (OTUC) cameras. The invention is also useful as a dosimeter to indicate or measure exposure to various types of radiation.

In one embodiment of the invention, an effective amount of a density inhibitor or density-inhibiting-agent-releasing compound inhibits the thermal (fog-density) development of unexposed silver particles (density) in the exposed areas relative to the unexposed areas of the element, the method comprises imagewise exposing the element or film with a non-solarizing amount of radiation/energy to form a latent image and thermally developing the latent image in a single development step to produce a positive image in the film.

In a preferred embodiment, one or more couplers or the like is present in the photothermographic element to accelerate development by removing Dox as it is formed, in order to drive development to Dmax.

Without wishing to be bound by theory, it is believed that thermal development in the present invention comprises (in order) two stages: a first stage comprising amplification of the latent image to form a relatively low-contrast negative image; and a second stage comprising imagewise inhibition of fog development (by an agent released by an inhibitor-releasing compound) to form a final relatively high-contrast positive image.

The present invention is also directed to a photothermographic element that can be used in the present process.

The present invention has the advantage of high speeds. In fact, the above-mentioned second-stage positive image, taken to full development in the unexposed areas, can be at least two stops faster than the first-stage negative image. Thus, the inventive method and accompanying photothermographic element can form a positive image of high speed and discrimination when exposed and heated 10 to 40 sec at 150 to 185° C. Images have excellent thermal and light stability. Dmins (minimum densities) are stable after extended incubation to heat or light. These and other advantages will be apparent from the detailed description below.

Definitions of other terms, as used herein, include the following:

In the descriptions of the photothermographic materials of the present invention, "a" or "an" component refers to "at least one" of that component.

Heating in a substantially water-free condition as used herein, means heating at a temperature of from about 150° C. to about 200° C. with little more than ambient water vapor present. The term "substantially water-free condition" means that the reaction system is approximately in equilibrium with water in the air, and water for inducing or promoting the reaction is not particularly or positively supplied from the exterior to the material. Such a condition is described in T. H. James, *The Theory of the Photographic Process*, Fourth Edition, Macmillan 1977, p 374.

"Emulsion layer," "imaging layer," or "photothermographic emulsion layer," means a layer of a photothermographic material that contains the photosensitive silver halide (when used) and non-photosensitive source of reducible silver ions.

"Non-photosensitive" means not intentionally light sensitive.

The term "organic silver salt" is herein meant to include salts as well as ligands comprising two ionized species. The silver salts used are preferably comprised of silver salts of organic coordinating ligands. Many examples of such organic coordinating ligands are described below. The silver donors can comprise asymmetrical silver donors or dimers such as disclosed in commonly assigned U.S. Pat. No. 5,466,804 to Whitcomb et al. In the case of such dimers, they are considered to be two separate organic silver salts such that only one silver atom is attributed to each organic silver salt. Organic silver salts can be in the form of core-shell particles as disclosed in commonly assigned Ser. No. 06/478,265and 06/468,398.

The terms "blocked developer" and "developer precursor" are the same and are meant to include developer precursors, blocked developer, hindered developers, and developers with blocking and/or timing groups, wherein the term "developer" is used to indicate a reducing substance for silver ion.

The term "image" and "imagewise" broadly refers, in one case, to any image or visual representation, including a picture, indicia, print, symbol, or positive indication or readout, including reproductions characterized by photographic-quality images as well as information-providing representations, including measurement indicators or signifiers such as a radiation dosimeter. Thus, in one kind of embodiment, an image can be made by a film in a camera and, in another kind of embodiment, an image can be made in a dosimeter by an source of radiation, whether the dosimeter is worn by an individual or situated in association with an intended or potential radiation source in the environmental or in a laboratory setting.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

DETAILED DESCRIPTION OF THE INVENTION

Figure 1:
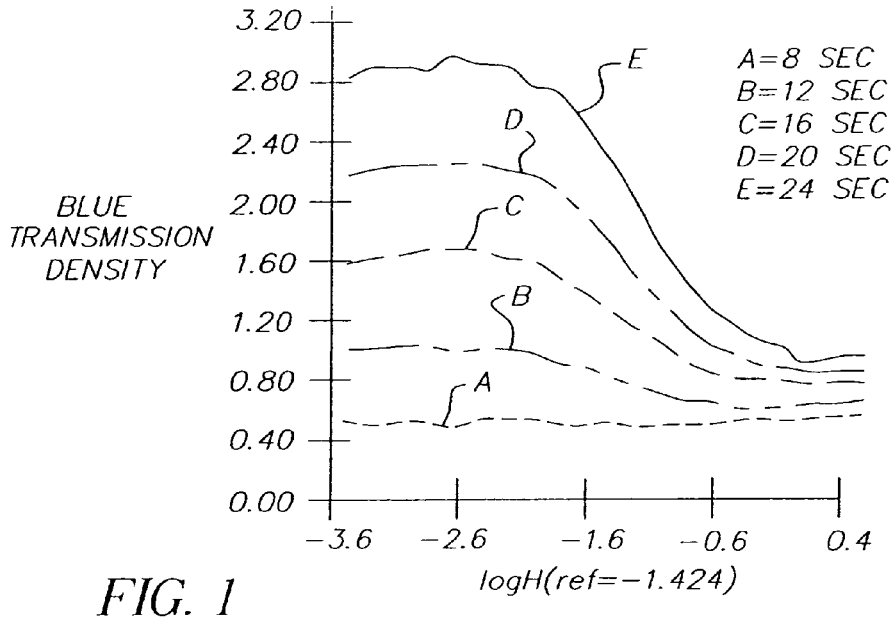
FIG. 1 is a graph (blue transmission density) showing the effect of development time on the photographic H&D curve for one embodiment of a photographic film according to the present invention as described in Example 11 below.

According to the method of the present invention, a positive image is formed in a photothermographic element (such as film) comprising a potentially negative-working emulsion by employing an inhibitor-releasing compound that imagewise inhibits fog-density development in exposed areas of the image during thermal development. The density inhibiting agent inhibits the thermal development of unexposed silver salts in the exposed areas relative to the unexposed areas, with the proviso that the element is imagewise exposed with a non-solarizing amount of actinic radiation to form a latent image and the latent image is thermally developed in a single development step, without any reversal steps or additional exposures to actinic radiation, to produce a positive image in the film.

In another aspect of the present invention, a photothermographic element is (comprising at least one image-forming layer coated on a support, said layer comprising at least one photographically active silver-halide emulsion spectrally sensitized to visible light and at least one non-light-sensitive organic silver salt) following imagewise exposure, is developed by heating at 150–200° C., to develop an imagewise reduced-silver image that is physically separate and morphologically distinct from the developed latent-image silver associated with the silver-halide grains. In one preferred embodiment, the photothermographic element comprises at least two non-light sensitive organic silver salts, a first and second organic silver salt, the second of which releases the inhibitor-releasing compound.

The present invention involves forming a high-speed, stable positive image when a photothermographic element is thermally developed. At least one imaging layer comprises a negative-working silver-halide emulsion, at least one non-light sensitive silver salt, an inhibitor-releasing compound, a developer or precursor thereof, and preferably a scavenging agent for the oxidized developer Dox.

In one preferred embodiment, for example, at least one imaging layer comprises a negative-working silver halide emulsion, two non-light-sensitive silver salts (at least one of which functions as an inhibitor-releasing compound), a blocked phenylenediamine developer, a phenolic developer/coupler, and a thermal solvent, for example, a hydroxy-substituted benzamide. One may also incorporate optional toners and accelerators known in the trade, examples of which include succinimide, phthalimide, naphthalimide, phthalazine, and phthalazinone. The above combination of materials develops a positive image when the exposed invention element is heated at a temperature of at least 150° C. for at least 20 sec, preferably at least 155° C. for at least 20 sec, most preferably 160° C. for 20 to 40 sec. Images can be formed having excellent discrimination and are resistant to print out. To Applicants' knowledge, this is the first example of photothermographic element incorporating a negative-working emulsion that develops a positive image when given a non-solarizing exposure and in the absence of multiple development steps as in reversal development. In contrast, a solarizing exposure is an extended exposure beyond the level required to produce a stable latent image. Less density develops in this case because the extended exposure causes the release of sufficient halogen to reoxidize the latent image. By the phrase "absence of multiple development steps" is meant that development occurs in a single unit-process step. Full development can occur during a heating step wherein once the film is heated to initiate development the development is complete before bringing the film back to temperature below which thermal development is initiated. For example, in one embodiment, the development is initiated above 150° C. and completed before bringing the temperature below 150° C. present process, There are no separate reversal steps, or reexposures of the photographic element, for complete development. Instead, thermal development, involving both a relatively low-contrast negative image and its change to a final positive image, occurs in a single or continuous heating step.

Without wishing to be bound by theory, Applicants believe the following occur during the present process. In an initial stage of thermal development, latent image amplification occurs in the normal sense to produce a low-contrast negative image. During this initial stage, a development inhibitor is released. The inhibitor is believed to shut down negative-image development shortly after initiation. In a second stage of thermal development, in which unexposed silver halide and non-light-sensitive silver salts are thermally developed or reduced to silver (referred to as "fogging") at sufficiently high temperature, the developed density in the initial negative-image development stage becomes the Dmin of the final positive image. A coupler, if present, may react with oxidized developer to form a negative image consisting dye plus silver. Colors can appear quite saturated in the negative image. With continued heating the exposed areas resist further development while the unexposed areas rapidly develop to a high-density fog.

If a coupler is present, the hue may appear less saturated in the unexposed areas. The result is a positive two-toned image possessing high speed and excellent light stability, suitable for scanning or, in some cases, for direct viewing.

Electron micrographs reveal that, during the second stage of thermal development, some of the silver development can occur off-grain and may involve the photographically inactive non-halide silver ion donors during dry physical development. Increasing exposure of the negative-working photosensitive silver halide grains results in less off-grain silver development. This provides the advantage of increased covering power and developed density in the areas of least exposure.

Without wishing to be bound by theory, the Applicants postulate that positive-image development occurs via formation of a sphere of inhibition around the exposed and partially developed negative-working silver-halide grains.

In a preferred embodiment, two different silver ion donors are present, one or both of which release a development or density-inhibiting agent. However, other sources of the development inhibitor can be used, for example, as a PUG (photographically useful group) that is releasable from a coupler or other compound present in the imaging layer. For example, in one embodiment of the invention, phenylmercaptotetrazole (PMT) or benzotriazole, two known development inhibitors commonly used in the trade to make DIR couplers (development-inhibitor-releasing couplers), are believed to accumulate during the initial stage of dry physical development in the vicinity of the partially amplified negative image, when only the latent image develops. It is postulated that at a critical concentration, the inhibitor shuts down further latent-image development and also slows the rate of fog formation or development in the exposed areas. The unexposed areas appear to produce fog at a normally high kinetic rate, fast enough to develop to a high density before released inhibitor can shut down development. The result is a positive image having high discrimination and speed.

In a preferred embodiment, the photographic speed of a given negative-working emulsion in the dry reversal coating format is 2–3 stops higher in photographic speed compared to conventional solution-processed or thermal-processed coatings that produce a negative image. Images are quite stable to extended exposure to light.

In one embodiment of the invention, in which the photographic element comprises two organic silver salts, the first organic silver salt exhibits a pKsp difference of at least 0.5, preferably at least 1.0, more preferably at least 2.0 less than the pKsp of the second organic silver salt or ligand. In one particularly preferred embodiment, the first organic silver ligand exhibits a cLogP of 0.1 to 10 and a pKsp of 7 to 14 and the second organic silver ligand exhibits a cLogP of 0.1 to 10 and a pKsp of 14 to 21. In another embodiment, the first organic silver salt, or salt of the first type, has a pKsp of 9 to 16 and the second organic silver salt, or the organic silver salt of the second type, has a pKsp of 12 to 19.

Both organic silver salts are present at levels above 5 g/mol of imaging silver halide. Preferably, the first organic silver salt is primarily the silver donor during the initial stage of thermal development (or the more reactive silver donor), at levels in the range of 5 to 3,000 g/mol of imaging silver halide. Preferably, the second organic silver salt acts as the thermal fog inhibitor, in the first stage of thermal development, and is present at levels in the range of 5 to 3,000 g/mol of imaging silver halide. Preferably, molar ratio of said first organic silver salt to said second organic silver salt is from about 0.1:10 to about 10:1.

In a preferred embodiment of the present invention, a photothermographic element has on a support one or more one light-sensitive imaging layers, each of said imaging layers comprising a light-sensitive silver emulsion, a binder, a dye-providing coupler or other Dox scavenger, and a developer or blocked developer. Preferably, the dyes or other compounds formed from the Dox scavenger in the layers are capable of forming a dye image of a visible or non-visible color. By the term "visible or non-visible colors" is meant that colorless compounds may absorb light outside the visible wavelength region (400–700 nm).

Although the minimum value of the indicated difference in pKsp is 0.5, preferably the difference in pKsp is at least 1.0, more preferably at least 2.0. The lower the temperature onset, however, the less the difference in pKsp that is needed. In one embodiment of the invention, both the first and second organic silver salt, or both the first and second type of organic silver salt, have a pKsp of greater than 11, preferably greater than 12, and neither are silver carboxylates, including silver behenate.

The activity solubility product or $pK_{sp}$ of an organic silver salt is a measure of its solubility in water. Some organic silver salts are only sparingly soluble and their solubility products are disclosed, for example, in Chapter 1 pages 7–10 of *The Theory of the Photographic Process*, by T. H. James, Macmillan Publishing Co. Inc., New Your (fourth edition 1977). Many of the organic silver salts consist of the replacement of a ligand proton with Ag+. The silver salts derived from mercapto compounds are relatively less soluble. The compound PMT has a $pK_{sp}$ of 16.2 at 25° C. as reported by Z. C. H. Tan et al., *Anal. Chem.*, 44, 411 (1972);

Z. C. H. Tan, *Phototgr. Sci. Eng.,* 19, 17 (1975). In comparison, benzotriazole, for example, has a $pK_{sp}$ of 13.5 at a temperature of 25° C. as reported by C. J. Battaglia, *Photogr. Sci. Eng.,* 14, 275 (1970).

In a preferred embodiment, the primary source of reducible, non-photosensitive silver in the practice of this invention are organic silver salts described as having the lower pKsp.

The first organic silver salt, or first type of organic silver salt, is preferably a non-photosensitive source of reducible silver ions (that is, silver salts) and can be any compound that contains reducible silver (1+) ions. Preferably, it is a silver salt that is comparatively stable to light and forms a silver image when heated to 50° C. or higher in the presence of an exposed photocatalyst (such as silver halide) and a reducing composition. In the imaging layer of the element, the photocatalyst and the non-photosensitive source of reducible silver ions must be in catalytic proximity (that is, reactive association). "Catalytic proximity" or "reactive association" means that they should be in the same layer, or in adjacent layers. It is preferred that these reactive components be present in the same emulsion layer.

According to the present invention, the organic silver salt referred to as the "organic silver donor" or "the first organic silver salt" or "organic silver salt of the first type" is generally the oxidatively more reactive organic silver salt compared to the second organic silver salt or second type of organic silver salt. This more reactive organic silver salt is preferably a silver salt of a nitrogen acid (imine) group, which can optionally be part of the ring structure of a heterocyclic compound. Aliphatic and aromatic carboxylic acids such as silver behenate or silver benzoate, in which the silver is associated with the carboxylic acid moiety, are specifically excluded as the organic silver donor compound. Compounds that have both a nitrogen acid moiety and carboxylic acid moiety are included as donors of this invention only insofar as the silver ion is associated with the nitrogen acid rather than the carboxylic acid group. The donor can also contain a mercapto residue, provided that the sulfur does not bind silver too strongly, and is preferably not a thiol or thione compound.

More preferably, a silver salt of a compound containing an imino group present in a heterocyclic nucleus can be used. Typical preferred heterocyclic nuclei include triazole, oxazole, thiazole, thiazoline, imidazoline, imidazole, diazole, pyridine and triazine. Examples of the first organic silver salt include derivatives of a tetrazole. Specific examples include but are not limited to 1H-tetrazole, 5-ethyl-1H-tetrazole, 5-amino-1H-tetrazole, 5-4'methoxyphenyl-1H-tetrazole, and 5-4'carboxyphenyl-1H-tetrazole.

The organic silver salt may also be a derivative of an imidazole. Specific examples include but are not limited to benzimidazole, 5-methyl-benzimidazole, imidazole, 2-methyl-benzimidazole, and 2-methyl-5-nitro-benzimidazole. The organic silver salt may also be a derivative of a pyrazole. Specific examples include but are not limited to pyrazole, 3,4-methyl-pyrazole, and 3-phenyl-pyrazole.

The organic silver salt may also be a derivative of a triazole. Specific examples include but are not limited to benzotriazole, 1H-1,2,4-trazole, 3-amino-1,2,4 triazole, 3-amino-5-benzylmercapto-1,2,4-triazole, 5,6-dimethyl benzotriazole, 5-chloro benzotriazole, and 4-nitro-6-chloro-benzotriazole.

Other silver salts of nitrogen acids may also be used. Examples would include but not be limited to o-benzoic sulfimide, 4-hydroxy-6-methyl-1,3,3A,7-tetraazaindene, 4-hydroxy-6-methyl-1,2,3,3A,7-pentaazaindene, urazole, and 4-hydroxy-5-bromo-6-methyl-1,2,3,3A,7-pentaazaindene.

Most preferred examples of the organic silver donor compounds include the silver salts of benzotriazole, triazole, and derivatives thereof, as mentioned above and also described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5 -mercaptobenzyl-1,2,4-triazole, a silver salt of 1H-tetrazole as described in U.S. Pat. No. 4,220,709.

Silver salt complexes may be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

Preferably, at least one organic silver donor is selected from one of the above-described compounds.

In a preferred embodiment, an oxidatively less reactive silver salt (the "second organic silver salt" or organic silver salt of the second type") is selected from silver salts of thiol or thione substituted compounds having a heterocyclic nucleus containing 5 or 6 ring atoms, at least one of which is nitrogen, with other ring atoms including carbon and up to two heteroatoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 2-mercaptobenzimidazole, a silver salt of 2-mercapto-5-aminothiadiazole, a silver salt of 5-carboxylic-1-methyl-2-phenyl-4-thiopyridine, a silver salt of mercaptotriazine, a silver salt of 2-mercaptobenzoxazole. These silver salts are herein referred to as "oxidatively less reactive silver salts."

The oxidatively less reactive silver salt may be a derivative of a thionamide. Specific examples would include but not be limited to the silver salts of 6-chloro-2-mercapto benzothiazole, 2-mercapto-thiazole, naptho(1,2-d)thiazole-2 (1H)-thione, 4-methyl-4-thiazoline-2-thione, 2-thiazolidinethione, 4,5-dimethyl-4-thiazoline-2-thione, 4-methyl-5-carboxy-4-thiazoline-2-thione, and 3-(2-carboxyethyl)-4-methyl-4-thiazoline-2-thione.

Preferably, the oxidatively less reactive silver salt is a derivative of a mercapto-triazole. Specific examples would include, but not be limited to, a silver salt of 3-mercapto-4-phenyl-1,2,4 triazole and a silver salt of 3-mercapto-1,2,4-triazole.

Most preferably the oxidatively less reactive silver salt is a derivative of a mercapto-tetrazole. In one preferred embodiment, a mercapto-tetrazole compound useful in the present invention is represented by the following structure (I):

(I)

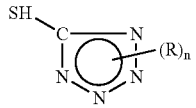

wherein n is 0 or 1, and R is independently selected from the group consisting of substituted or unsubstituted alkyl, aralkyl, or aryl. Substituents include, but are not limited to, C1 to C6 alkyl, nitro, halogen, and the like, which substituents do not adversely affect the thermal fog inhibiting effect of the silver salt. Preferably, n is 1 and R is an alkyl having 1 to 16 carbon atoms or a substituted or unsubstituted phenyl group. Specific examples include but are not limited to silver salts of 1-phenyl-5-mercapto-tetrazole, 1-(3-acetamido)-5-mercapto-tetrazole, or 1-[3-(2-sulfo)benzamidophenyl]-5-mercapto-tetrazole.

In one embodiment of the invention, a first organic silver salt is a benzotriazole or derivative thereof and a second organic silver salt is a mercapto-functional compound, preferably mercapto-heterocyclic compound. Particularly preferred is 1-phenyl-5-mercapto-tetrazole (PMT).

In general, an organic silver salt is formed by mixing silver nitrate and other salts with the free base of the organic ligand such as PMT. By raising the pH sufficiently with alkaline base, the silver salt of PMT can be precipitated, typically in spheroids 20 nm in diameter and larger.

In a particularly preferred embodiment, the photothermographic element comprises at least one image forming layer coated on a support, wherein said layer comprises at least one silver halide emulsion, optionally chemically and spectrally sensitized to visible or infrared radiation, an organic silver salt having Structure (I), a silver salt having Structure (II) below, an optional thermal solvent selected from Structures (IIIA–IIIC), a phenolic coupler of Structure (IV) below, and an amine developer or precursor thereof having Structure (V) below. Such an element is capable of producing a positive image after a single exposure and single thermal development unit step.

The silver salt of Structure (IA) has the general structure:

(IA)

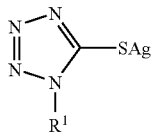

wherein $R^1$ is alkyl, cycloalkyl, substituted alkyl, phenyl, aryl, substituted aryl or phenyl.

The silver salt of Structure (II) has the general structure:

(II)

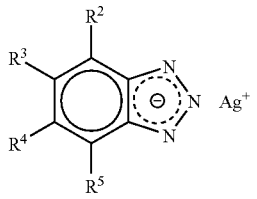

wherein $R^2$, $R^3$, $R^4$, and $R^5$ may be independently selected from hydrogen, halide, alkyl, alkoxy, aryl, phenyl, phenoxy, carboxy, alkyl, cycloalkyl, substituted alkyl, substituted aryl, substituted phenyl, wherein said substituted alkyl, aryl or phenyl groups may also contain O, N, S, halide, sulfonic acid, sulfone, sulfonamide, carboxylic acid, ester, aldehyde, ketone, amine, or amide; and wherein at least two of $R^2$, $R^3$, $R^4$, and $R^5$ may be part of an additional ring structure.

Prior art thermal solvents for a heat processed photographic elements are disclosed in U.S. Pat. No. 6,277,537, U.S. Pat. No. 5,436,109; U.S. Pat. No. 5,843,618, U.S. Pat. No. 5,480,761, U.S. Pat. No. 5,480,760, U.S. Pat. No. 5,468,587, U.S. Pat. No. 5,352,561, U.S. Pat. No. 5,064,742. These are also useful in the current invention although optional. When used, preferred thermal solvents have a hydroxy-benzamide structure as shown in Structures (IIIA)–(IIIC):

(IIIA)

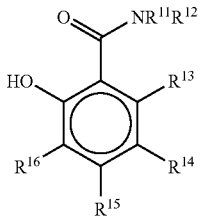

(IIIB)

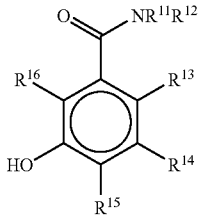

(IIIC)

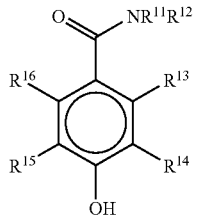

wherein $R^{11}$, $R^{12}$, $R^{13}$, $R^{14}$, $R^{15}$, and $R^{16}$, which can be the same or different individually, can be hydrogen, alkyl, substituted alkyl, alkenyl, substituted alkenyl, aryl, substituted aryl, halogen, cyano, alkoxy, substituted alkoxy, aryloxy, substituted aryloxy, amino, substituted amino, alkylcarbonamido, substituted alkylcarbonamido, arylcarbonamido, substituted arylcarbonamido, alkylsulfonamido, arylsulfonamido, substituted alkylsulfonamido, substituted arylsulfonamido, or sulfamyl; or wherein at least two of $R^{11}$, $R^{12}$, $R^{13}$, $R^{14}$, $R^{15}$, and $R^{16}$ together can further form a substituted or unsubstituted carbocyclic or heterocyclic ring structure that can further be substituted or unsubstituted.

Representative thermal solvents include:

TS-1

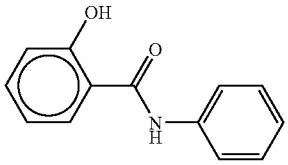

TS-2

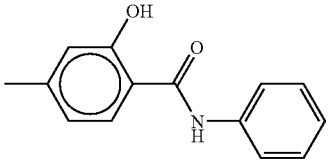

TS-3

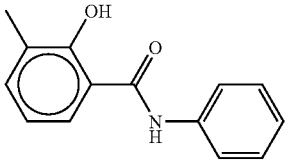

TS-4

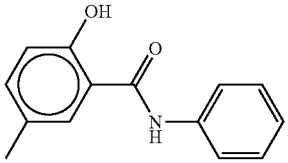

TS-5

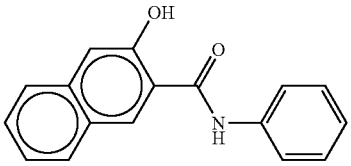

TS-6

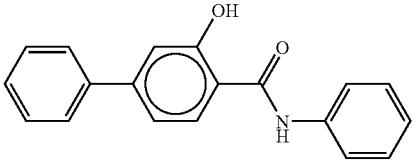

TS-7

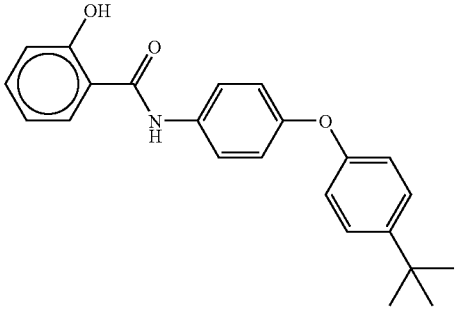

In the preferred embodiment, the imaging element comprises a phenolic coupler represented by the following Structure (IV):

(IV)

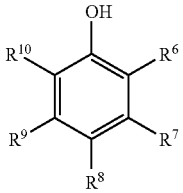

wherein $R^6$, $R^7$, $R^8$, $R^9$ and $R^{10}$ may independently be selected from hydrogen, hydroxyl, alkyl, alkoxy,

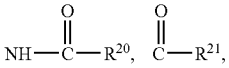

$NH—SO_2R^{22}$, $SO_2NHR^{23}$, wherein $R^{20}$, $R^{21}$, $R^{22}$, $R^{23}$ are independently selected from alkyl, haloalkyl, hydroxyl, amino, substituted amino, arylamino, substituted arylamino, aryl, substituted aryl, phenyl, substituted phenyl, alkoxy, aryloxy, substituted aryloxy, phenoxy, and substituted phenoxy, or wherein at least two of $R^7$, $R^8$, and $R^9$ together can further form a substituted or unsubstituted carbocyclic or heterocyclic ring structure. Such compounds are exemplified by, and include all the couplers disclosed in GB 2018453A to Willis, hereby incorporated by reference in its entirety.

Such couplers have the property that they are relatively inactive as couplers. This allows them to function as Dox scavengers to maximize Dmax in the positive image while, at the same time, minimizing the Dmin (or Dmax of the temporary or low-contrast negative image) during thermal development.

Some phenolic couplers may also behave as thermal solvents. It is preferable that one material satisfy more than one function, but it is not necessary.

Examples of phenolic couplers include:

PC-1

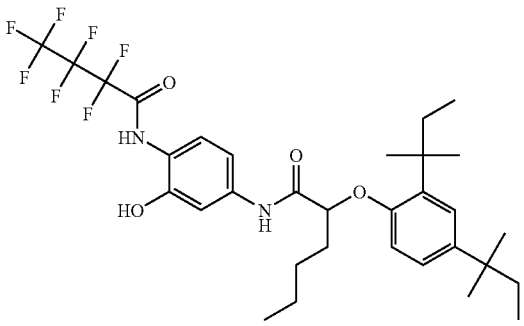

PC-2

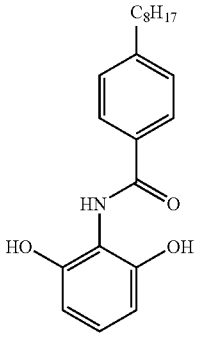

PC-3

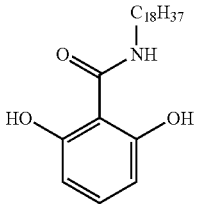

-continued

PC-4

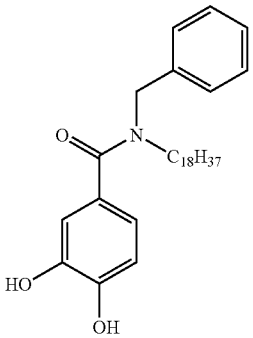

As indicated above, a photothermographic process typically employs blocked developers that decompose (i.e., unblock) on thermal activation to release a developing agent. By a "dry thermal process" or "dry photothermographic" process is meant herein a process involving, after imagewise exposure of the photothermographic element, developing the resulting latent image by the use of heat to raise the temperature of the photothermographic element or film to a temperature of at least about 150° C., preferably at least about 155° C., more preferably at about 160° C. to 180° C., without liquid processing of the film, preferably in an essentially dry process without the application of aqueous solutions. By an essentially dry process is meant a process that does not involve the uniform saturation of the film with a liquid, solvent, or aqueous solution. Thus, contrary to photothermographic processing involving low-volume liquid processing, the amount of water required is less than 1 times, preferably less than 0.4 times and more preferably less than 0.1 times the amount required for maximally swelling total coated layers of the film excluding a back layer. Most preferably, no liquid is required or applied added to the film during thermal treatment. Preferably, no laminates are required to be intimately contacted with the film in the presence of aqueous solution.

Preferably, during thermal development an internally located blocked developing agent in reactive association with each of light-sensitive layers becomes unblocked to form a developing agent, whereby the unblocked developing agent is imagewise oxidized on development and this oxidized form reacts with the dye-providing couplers or other Dox scavenger.

The components of the photothermographic element can be in any location in the element that provides the desired image. If desired, one or more of the components can be in one or more layers of the element. For example, in some cases, it is desirable to include certain percentages of the reducing agent, toner, thermal solvent, stabilizer and/or other addenda in the overcoat layer over the photothermographic image recording layer of the element. This, in some cases, reduces migration of certain addenda in the layers of the element.

It is necessary that the components of the photographic combination be "in association" with each other in order to produce the desired image. The term "in association" herein means that in the photothermographic element the photographic silver halide and other components of the image-forming combination are in a location with respect to each other that enables the desired processing and forms a useful image. This may include the location of components in different layers.

Preferably, development processing is carried out (i) for less than 60 seconds, (ii) at the temperature from 150 to 200° C., and (iii) without the application of any aqueous solution.

Dry thermal development of a black-and-white photothermographic film for general use with respect to consumer cameras provides significant advantages in processing ease and convenience, since they are developed by the application of heat without wet processing solutions. Such film is especially amenable to development at kiosks, with the use of essentially dry equipment. Thus, it is envisioned that a consumer could bring an imagewise exposed photothermographic film, for development and printing, to a kiosk located at any one of a number of diverse locations, optionally independent from a wet-development lab, where the film could be developed and printed requiring little, preferably no manipulation by third-party technicians. It is also envisioned that a consumer could own and operate such film development equipment at home, particularly since the system is dry and does not involve the application and use of complex or hazardous chemicals. Thus, the dry photothermographic system opens up new opportunities for greater convenience, accessibility, and speed of development (from the point of image capture by the consumer to the point of prints in the consumer's hands), even essentially "immediate" development in the home for a wide cross-section of consumers.

By kiosk is meant an automated free-standing machine, self-contained and (in exchange for certain payments or credits) capable of developing a roll of imagewise exposed film on a roll-by-roll basis, without requiring the intervention of technicians or other third-party persons such as necessary in wet-chemical laboratories. Typically, the customer will initiate and control the carrying out of film processing and optional printing by means of a computer interface. Such kiosks typically will be less than 6 cubic meters in dimension, preferably about 3 cubic meters or less in dimension, and hence commercially transportable to diverse locations. Such kiosks may optionally comprise a heater for development, a scanner for digitally recording the image, and a device for transferring the image to a display element.

Assuming the availability and accessibility of such kiosks, such photothermographic films could potentially be developed at any time of day, "on demand," in a matter minutes, without requiring the participation of third-party processors, multiple-tank equipment and the like. Such photothermographic processing could potentially be done on an "as needed" basis, even one roll at a time, without necessitating the high-volume processing that would justify, in a commercial setting, equipment capable of high-throughput. The kiosks thus envisioned would be capable of heating the film to develop an image and then subsequently scanning the film on an individual consumer basis, with the option of generating a display element corresponding to the developed image.

In view of advances in the art of scanning technologies, it has now become natural and practical for photothermographic films such as disclosed in EP 0762 201 to be scanned, which can be accomplished without the necessity of removing the silver or silver halide from the negative, although special arrangements for such scanning can be made to improve its quality. See, for example, Simons U.S. Pat. No. 5,391,443. Method for the scanning of such films are also disclosed in commonly assigned U.S. Ser. No. 09,855,046 and U.S. Ser. No. 09,855,051, hereby incorporated by reference in their entirety.

A simple technique is to scan the photographic element point-by-point along a series of laterally offset parallel scan paths. A sensor that converts radiation received into an electrical signal notes the intensity of light passing through the element at a scanning point. Most generally this electronic signal is further manipulated to form a useful electronic record of the image. For example, the electrical signal can be passed through an analog-to-digital converter and sent to a digital computer together with location information required for pixel (point) location within the image. The number of pixels collected in this manner can be varied as dictated by the desired image quality. Very low resolution images can have pixel counts of 192×128 pixels per film frame, low resolution 384×256 pixels per frame, medium resolution 768×512 pixels per frame, high resolution 1536×1024 pixels per frame and very high resolution 3072×2048 pixels per frame or even 6144×4096 pixels per frame or even more. Higher pixel counts or higher resolution translates into higher quality images because it enables higher sharpness and the ability to distinguish finer details especially at higher magnifications at viewing. These pixel counts relate to image frames having an aspect ratio of 1.5 to 1. Other pixel counts and frame aspect ratios can be employed as known in the art. Most generally, a difference of four times between the number of pixels rendered per frame can lead to a noticeable difference in picture quality, while differences of sixteen times or sixty four times are even more preferred in situations where a low quality image is to be presented for approval or preview purposes but a higher quality image is desired for final delivery to a customer. On digitization, these scans can have a bit depth of between 6 bits per color per pixel and 16 bits per color per pixel or even more. The bit depth can preferably be between 8 bits and 12 bits per color per pixel. Larger bit depth translates into higher quality images because it enables superior tone and color quality.

The electronic signal can form an electronic record that is suitable to allow reconstruction of the image into viewable forms such as computer monitor displayed images, television images, optically, mechanically or digitally printed images and displays and so forth all as known in the art. The formed image can be stored or transmitted to enable further manipulation or viewing, such as in U.S. Ser. No. 09/592,816 titled AN IMAGE PROCESSING AND MANIPULATION SYSTEM to Richard P. Szajewski, Alan Sowinski and John Buhr.

The support for the photothermographic element can be either reflective or transparent, which is usually preferred. When reflective, the support is white and can take the form of any conventional support currently employed in print elements. When the support is transparent, it can be colorless or tinted and can take the form of any conventional support currently employed in photographic film elements—e.g., a colorless or tinted transparent film support. Details of support construction are well understood in the art. Examples of useful supports are poly(vinylacetal) film, polystyrene film, poly(ethyleneterephthalate) film, poly(ethylene naphthalate) film, polycarbonate film, and related films and resinous materials, as well as paper, cloth, glass, metal, and other supports that withstand the anticipated processing conditions.

The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure I*.

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. No. 4,279,945, and U.S. Pat. No. 4,302,523.

Any convenient selection from among conventional radiation-sensitive silver-halide emulsions can be incorporated within the layer units and used to provide the spectral absorptances of the invention. Most commonly, in camera film at least, high bromide emulsions containing a minor amount of iodide are employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thickness are less than 0.3 μm (most preferably less than 0.2 μm). Ultra thin tabular grain emulsions, those with mean tabular grain thickness of less than 0.07 μm, are specifically contemplated. The grains preferably form surface latent images so that they are capable of producing negative images when processed in a solution surface developer.

Illustrations of conventional radiation-sensitive silver halide emulsions are provided by *Research Disclosure I*, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver-halide grains to be used in the invention may be prepared according to methods known in the art, such as those described in *Research Disclosure I*, cited above, and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I*, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure*, I. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 $g/m^2$ of silver. Silver quantities of less than 7 $g/m^2$ are preferred, and silver quantities of less than 5 $g/m^2$ are even more preferred. The lower quantities of silver improve the optics of the elements, thus enabling the production of sharper pictures using the elements. These lower quantities of silver are additionally important in that they enable rapid development and desilvering of the elements.

The photographic elements may further contain other image-modifying compounds such as "Development-Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613. DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the photothermographic embodiment of the invention is preferably subdivided into at least two, and more preferably three or more sub-unit layers. It is preferred that all light-sensitive silver-halide emulsions in the image recording unit have spectral sensitivity in the same region of the visible spectrum. In this embodiment, while all silver-halide emulsions incorporated in the unit have spectral absorptances according to invention, it is expected that there are minor differences in spectral absorptance properties between them. In still more preferred embodiments, the sensitizations of the slower silver-halide emulsions are specifically tailored to account for the light-shielding effects of the faster silver-halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The photothermographic element may comprise an anti-halation layer unit that contains a decolorizable light absorbing material, such as one or a combination of pigments and dyes. Suitable materials can be selected from among those disclosed in *Research Disclosure I*, Section VIII. Absorbing materials.

The photothermographic element may further comprise a surface overcoat SOC which are typically hydrophilic colloid layers that are provided for physical protection of the elements during handling and processing. Each SOC also provides a convenient location for incorporation of addenda that are most effective at or near the surface of the element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure I*, Section IX. Coating physical property modifying addenda. The SOC overlying the emulsion layers additionally preferably contains an ultraviolet absorber, such as illustrated by *Research Disclosure I*, Section VI. UV dyes/optical brighteners/luminescent dyes, paragraph (1).

Elements having excellent light sensitivity are best employed in the practice of this invention. Photothermographic elements should have a sensitivity of at least about ISO 1, preferably have a sensitivity of at least about ISO 100, and more preferably have a sensitivity of at least about ISO 400. Elements having a sensitivity of up to ISO 20000 or even higher are specifically contemplated. The speed, or sensitivity, of a photographic element is inversely related to the exposure required to enable the attainment of a specified density above Dmin after processing.

Photographic speed for a reversal black-and-white film element has been specifically defined by the Federal Standard Relative Sensitivity, Method B (Fed. Std. No. 170a, Mar. 31, 1967) and relates specifically the exposure H (in lux-seconds) at the point on the total density versus log exposure curve where the density is 1.00 greater than base plus minimum density. Speed equals 10/H.

The present invention also contemplates the use of photographic elements of the present invention in what are often referred to as single-use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al, U.S. Pat. No. 4,345,835; moisture-proofing as described at Fujimura et al, U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure I*, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The photothermographic elements of the present invention are preferably of type B as disclosed in *Research Disclosure I*. Type B elements contain in reactive association a photosensitive silver halide, a reducing agent or developer, optionally an activator, a coating vehicle or binder, and a salt or complex of an organic compound with silver ion. In these systems, this organic complex is reduced during development to yield silver metal, the organic silver salt is referred to as the silver donor. References describing such imaging elements include, for example, U.S. Pat. Nos. 3,457,075; 4,459,350; 4,264,725 and 4,741,992. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

The photosensitive silver-halide grains and the organic silver salts of the present invention can be coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

Examples of preferred blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.;

U.S. Pat. No. 4,060,418, to Waxman and Mourning; and in U.S. Pat. No. 5,019,492. Particularly useful are those blocked developers described in U.S. application Ser. No. 09/476,234, filed Dec. 30, 1999, IMAGING ELEMENT CONTAINING A BLOCKED PHOTOGRAPHICALLY USEFUL COMPOUND; U.S. application Ser. No. 09/475,691, filed Dec. 30, 1999, IMAGING ELEMENT CONTAINING A BLOCKED PHOTOGRAPHICALLY USEFUL COMPOUND; U.S. application Ser. No. 09/475,703, filed Dec. 30, 1999, IMAGING ELEMENT CONTAINING A BLOCKED PHOTOGRAPHICALLY USEFUL COMPOUND; U.S. application Ser. No. 09/475,690, filed Dec. 30, 1999, IMAGING ELEMENT CONTAINING A BLOCKED PHOTOGRAPHICALLY USEFUL COMPOUND; and U.S. application Ser. No. 09/476,233, filed Dec. 30, 1999, PHOTOGRAPHIC OR photothermographic ELEMENT CONTAINING A BLOCKED PHOTOGRAPHICALLY USEFUL COMPOUND. Further improvements in blocked developers are disclosed in U.S. Ser. No. 09/710,341, U.S. Ser. No. 09/718,014, U.S. Ser. No. 09/711,769, and U.S. Ser. No. 09/710,348. Yet other improvements in blocked developers and their use in photothermographic elements are found in commonly assigned co-pending applications, filed concurrently herewith, U.S. Ser. Nos. 09/718,027 and U.S. Ser. No. 09/717,742.

In one embodiment of the invention blocked developer for use in the present invention may be represented by the following Structure V:

$$\text{DEV-(LINK 1)}_l\text{-(TIME)}_m\text{-(LINK 2)}_n\text{-B} \qquad \text{V}$$

wherein,

DEV is a silver halide color developing agent;

LINK 1 and LINK 2 are linking groups;

TIME is a timing group;

1 is 0 or 1;

m is 0, 1, or 2;

n is 0 or 1;

1+n is 1 or 2;

B is a blocking group or B is:

$$\text{-B'-(LINK2)}_n\text{-(TIME)}_m\text{-(LINK 1)}_l\text{-DEV}$$

wherein B' also blocks a second developing agent DEV.

In a preferred embodiment of the invention, LINK 1 or LINK 2 are of Structure VI:

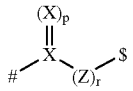

VI wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1; with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

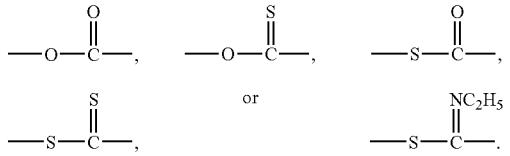

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Other blocked developers that can be used are, for example, those blocked developers disclosed in U.S. Pat. No. 6,303,282 B1 to Naruse et al., U.S. Pat. No. 4,021,240 to Cerquone et al., U.S. Pat. No. 5,746,269 to Ishikawa, U.S. Pat. No. 6,130,022 to Naruse, and U.S. Pat. No. 6,177,227 to Nakagawa, and substituted derivatives of these blocked developers. Although the present invention is not limited to any type of developing agent or blocked developing agent, the following are merely some examples of some photographically useful blocked developers that may be used in the invention to produce developers during heat development.

D-2

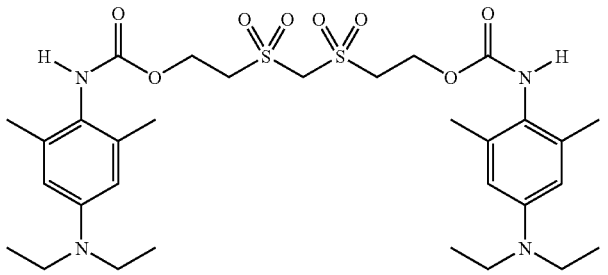

-continued
D-3
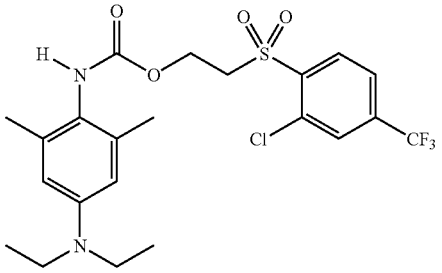
D-4
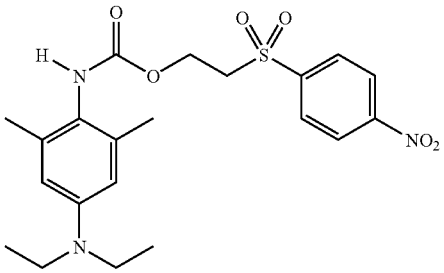
D-6
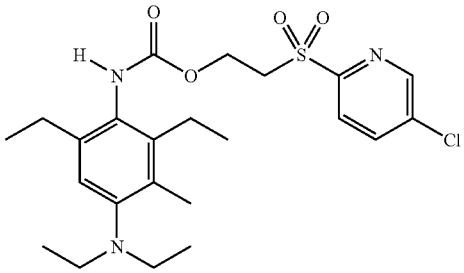
D-7
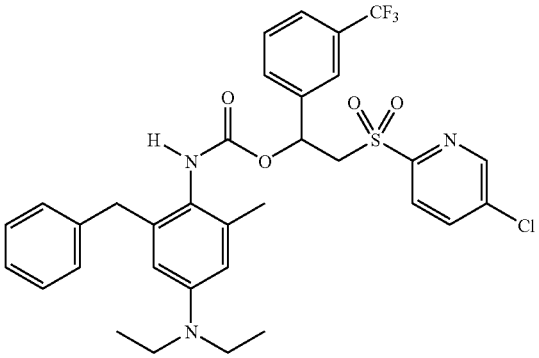
D-8
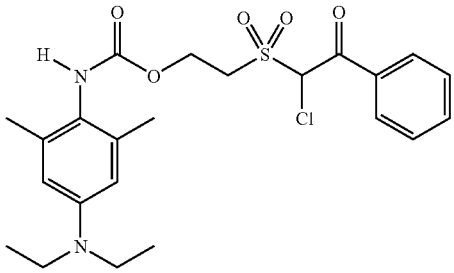

-continued
D-9
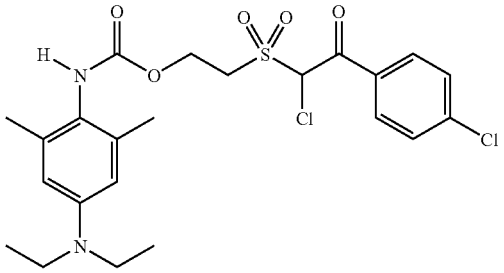
D-10
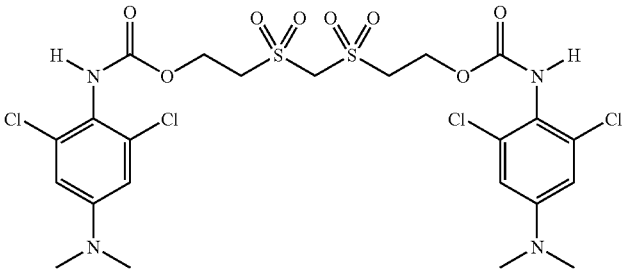
D-11
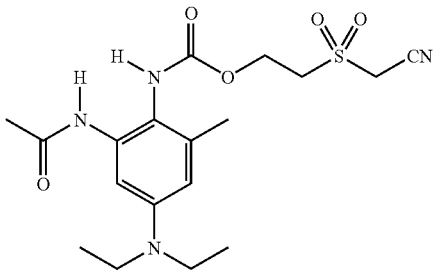
D-12
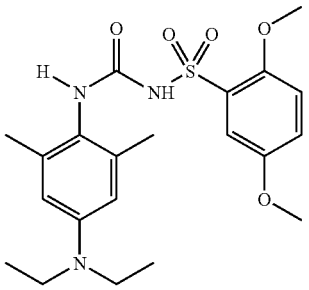
D-13
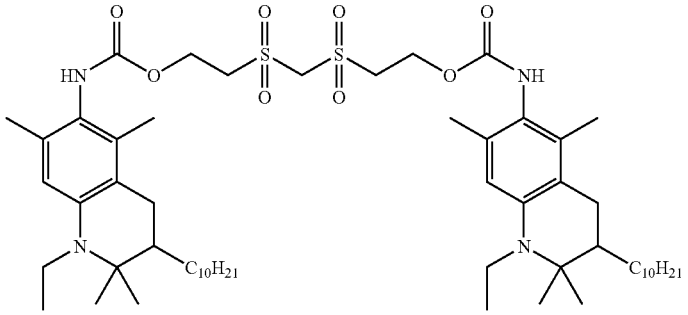

-continued
D-14
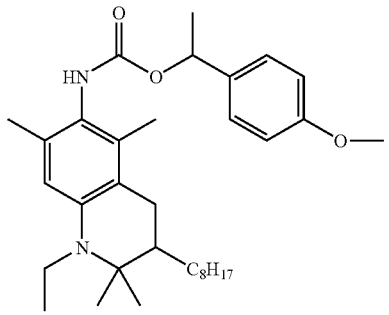
D-15
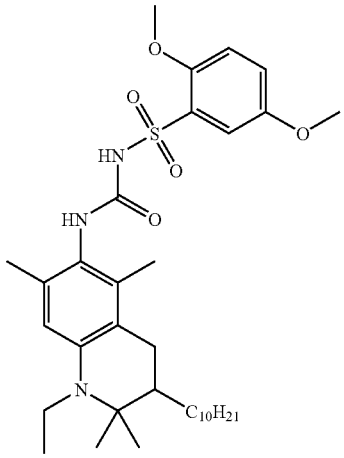
D-16
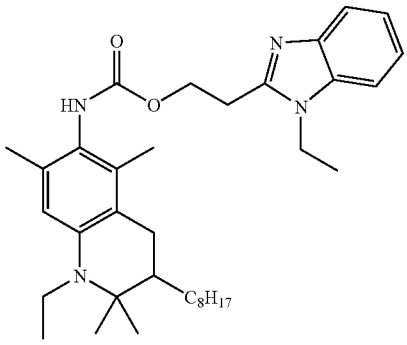

-continued

D-17

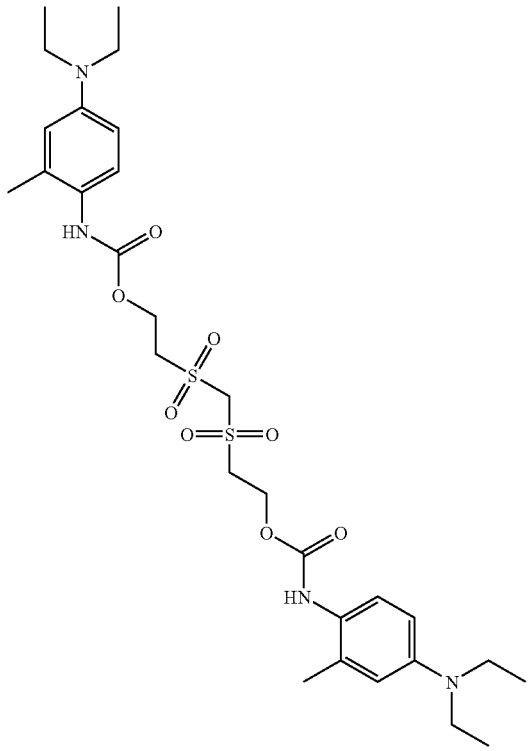

In the preferred embodiment, the blocked developer is preferably incorporated in one or more of the imaging layers of the imaging element. The amount of blocked developer used is preferably 0.01 to 5 g/m$^2$, more preferably 0.1 to 2 g/m$^2$ and most preferably 0.3 to 2 g/m$^2$ in each layer to which it is added. These may be color forming or non-color forming layers of the element. After imagewise exposure of the imaging element, the blocked developer is activated during processing of the imaging element by the presence of acid or base, by heating the imaging element during processing of the imaging element, and/or by placing the imaging element in contact with a separate element, such as a laminate sheet, during processing. The laminate sheet optionally contains additional processing chemicals such as those disclosed in Sections XIX and XX of *Research Disclosure*, September 1996, Number 389, Item 38957 (hereafter referred to as ("*Research Disclosure I*"). All sections referred to herein are sections of *Research Disclosure I*, unless otherwise indicated. Such chemicals include, for example, sulfites, hydroxylamine, hydroxamic acids and the like, antifoggants, such as alkali metal halides, nitrogen containing heterocyclic compounds, and the like, sequestering agents such as an organic acids, and other additives such as buffering agents, sulfonated polystyrene, stain reducing agents, biocides, desilvering agents, stabilizers and the like.

A reducing agent in addition to, or instead of, the blocked developer may be included in the photothermographic element. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 1 to 25 percent of the photothermographic layer.

A wide range of reducing agents has been disclosed in dry silver systems including amidoximes such as phenylamidoxime, 2-thienylamidoxime and p-phenoxy-phenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; bis-naphthols as illustrated by 2,2'-dihydroxyl-1-binaphthyl, 6,6'-dibromo-2,2'-dihydroxy-1,1'-binaphthyl, and bis(2-hydroxy-1-naphthyl)methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzene-sulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

It is contemplated that the photothermographic element contains a thermal solvent. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Pat. No. 4,123,282.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, anti-static agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis(tribromomethyl)-s-triazines, such as 6-methyl or 6-phenyl-2,4-bis (tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. Heating means known in the photothermographic arts are useful for providing the desired processing temperature for the exposed photothermographic element. The heating means is, for example, a simple hot plate, iron, roller, heated drum, microwave heating means, heated air, vapor or the like. It is contemplated that the design of the processor for the photothermographic element be compatible to the design of the cassette, cartridge, or film packet used for storage and use of the element. Further, data stored on the film or cartridge may be used to modify processing conditions or scanning of the element. Methods for accomplishing these steps in the imaging system are disclosed in commonly assigned, copending U.S. patent application Ser. Nos. 09/206,586, 09/206,612, and 09/206,583 filed Dec. 7, 1998, which are incorporated herein by reference. The use of an apparatus whereby the processor can be used to write information onto the element, information which can be used to adjust processing, scanning, and image display is also envisaged. This system is disclosed in U.S. patent application Ser. No. 09/206,914 filed Dec. 7, 1998 and Ser. No. 09/333,092 filed Jun. 15, 1999, which are incorporated herein by reference.

Thermal processing is preferably carried out under ambient conditions of pressure and humidity. Conditions outside of normal atmospheric pressure and humidity may be used.

It is contemplated that imaging elements of this invention may be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The following examples illustrate the practice of this invention. They are not intended to be exhaustive of all possible variations of the invention. Parts and percentages are by weight unless otherwise indicated.

EXAMPLES

Silver Salt Dispersion SS-1:

A stirred reaction vessel was charged with 480 g of lime processed gelatin and 5.61 of distilled water. A solution containing 0.7 M silver nitrate was prepared (Solution A). A solution containing 0.7 M benzotriazole and 0.7 M NaOH was prepared (Solution B). The mixture in the reaction vessel was adjusted to a pAg of 7.25 and a pH of 8.00 by additions of Solution B, nitric acid, and sodium hydroxide as needed.

Solution A was added with vigorous mixing to the kettle at 38 cc/minute, and the pAg was maintained at 7.25 by a simultaneous addition of solution B. This process was continued until the quantity of silver nitrate added to the vessel was 3.54 M, at which point the flows were stopped and the mixture was concentrated by ultrafiltration. The resulting silver salt dispersion contained fine particles of silver benzotriazole.

Silver Salt Dispersion SS-2:

A stirred reaction vessel was charged with 480 g of lime processed gelatin and 5.61 of distilled water. A solution containing 0.7 M silver nitrate was prepared (Solution A). A solution containing 0.7 M 1-phenyl-5-mercaptotetrazole and 0.7 M NaOH was also prepared (Solution B). The mixture in the reaction vessel was adjusted to a pAg of 7.25 and a pH of 8.00 by additions of Solution B, nitric acid, and sodium hydroxide as needed.

Solution A was added to the kettle at 19.6 cc/minute, and the pAg was maintained at 7.25 by a simultaneous addition of solution B. This process was continued until the 3.54 moles of silver nitrate had been added to the vessel, at which point the flows were stopped and mixture was concentrated by ultrafiltration. The resulting silver salt dispersion contained fine particles of the silver salt of 1-phenyl-5-mercaptotetrazole.

Emulsion E-1:

Emulsion example E-1 is a bromoiodide emulsion containing tabular grains having a mean equivalent circular diameter of 2.1 μm and a mean thickness of 0.12 μm. The tabular grains accounted for greater than 90% of the total grain projected area. Each of the tabular grains was formed with a silver bromide host portion and silver iodobromide laminae formed by the abrupt addition of iodide. The overall bulk iodide content was 3.7 mole %. Both iridium and selenium were incorporated as dopants. Potassium hexachloroiridate was doped at a concentration of 6 molar parts per billion (mppb) at a placement of 62 to 68% of the total silver. Potassium selenocyanate was doped at a concentration of 1.4 mppm at a placement of 68% of the total silver.

The emulsion was then chemically and spectrally sensitized. The following spectral sensitizing dyes were used for sensitization:

Spectral Sensitizing Dyes:

GSD-1:Anhydro-5-chloro-9 ethyl-5'-phenyl-3'-(3-sulfobutyl)-3-(3-sulfopropyl)-oxacarbocyanine hydroxide, sodium salt.

GSD-5: Anhydro-3,9-diethyl-3'-[N-(methylsulfonyl)carbamoylmethyl]-5-phenylbenzothiazolo oxacarbocyanine hydroxide.

A 0.25 mole sample of emulsion was melted at 40° C. Next an aqueous solution containing 120 mg/Ag mole of sodium thiocyanate was added, followed by the addition of an aqueous solution containing 20 mg/Ag mole of benzothiazolium tetrafluoroborate. GSD-1 and GSD-5 were then added with stirring to the emulsion, in a molar ratio of 4:1 at a level of 0.86 millimoles of total dye per Ag mole. Gold and sulfur-containing chemical sensitizers were then added at levels chosen to provide a substantially optimum sensitization and the temperature of the emulsion was raised to 60° C. and held for 14 minutes. The emulsion was then cooled to 40° C. and an aqueous solution containing 125 mg of 4-hydroxy-6-methyl-1,3,3a,7-tetraazaindene, sodium salt was added.

The above chemical and spectral finish is in accordance with standard trade practice for color negative film applications. When exposed to light, the silver halide grains form surface latent image that amplifies during solution development to form a silver/dye negative image. C-41 is a typical process.

Developer Dispersion, DD-1:

A dispersion of developer D-17 was prepared by the method of ball milling. For each gram of incorporated developer, 0.2 g of sodium tri-isopropylnaphthalene sulfonate, 10 g of water, and 25 ml of beads were added. Following milling, the zirconia beads were removed by filtration. The slurry was refrigerated prior to use.

D-17

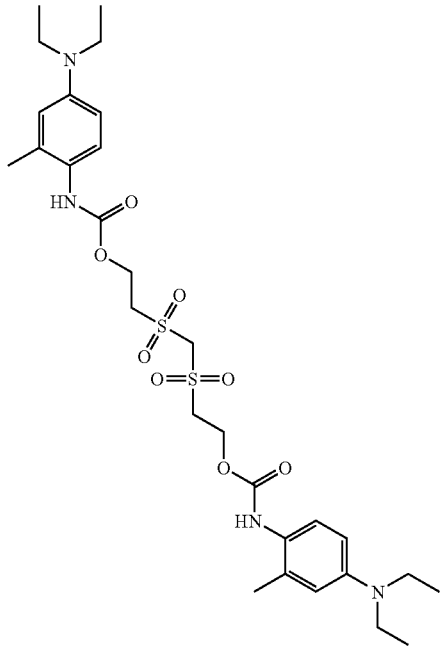

Thermal Solvent Dispersion, TSD-1:

A dispersion of salicylanilide (TS-1) was prepared by the method of ball milling. A total of 19 g of slurry was produced by combining 3.0 g TS-1 solid, 0.20 g polyvinyl pyrrolidone, 0.20 g TRITON X-200 surfactant, and 15.6 g distilled water. To this mixture was added 20 ml of zirconia beads. The slurry was ball milled for 48 hours. Following milling, the zirconia beads were removed by filtration. At this point, 1 g of gelatin was added, allowed to swell, and then dissolved in the mixture by heating at 40 C. The resulting mixture was chill set to yield a dispersion containing 5% gelatin and 15% TS-1.

Phenolic Coupler Dispersion, PCD-1:

A dispersion of cyan coupler PC-1 was prepared by the method of ball milling. A total of 200 g of slurry was produced by combining 20 g PC-1 solid, 30 g of 10% oleylmethyltaurate, and 150 g distilled water. To this mixture was added 475 ml of 1.8 mm zirconia beads. The slurry was ball milled for 72 hours. Following milling, the zirconia beads were removed by filtration.

PC-1

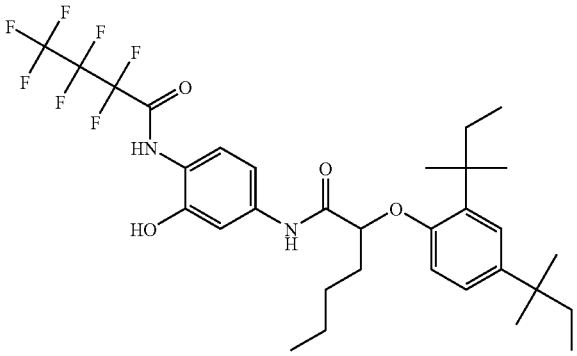

Phenolic Coupler Dispersion, PCD-2:

Phenolic coupler PC-1 (30 g) was dissolved in 60 g ethyl acetate at 60° C. Another solution was prepared by combining 40 g gelatin, 337.5 g water and 32.5 g of 10% 2-Naphthalenesulfonic acid, tris(1-methylethyl)-, sodium salt and heating at 50° C. The solutions were combined and passed through a colloid mill five times. The ethyl acetate was removed by rotary evaporation for 20 minutes.

Phenolic Coupler Dispersion, PCD-3:

A dispersion of phenolic coupler PC-2 was prepared by the method of ball milling. A slurry was produced by combining 20 g PC-2 solid, 20 g of 10% polyvinyl pyrrolidone, and 160.0 g distilled water. To this mixture was added 475 ml of 1.8 mm zirconia beads. The slurry was ball milled for 72 hours. Following milling, the zirconia beads were removed by filtration.

PC-2

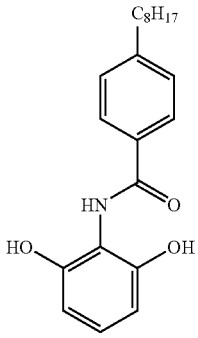

Phenolic Coupler Dispersion, PCD-4:

A dispersion of phenolic coupler PC-3 was prepared by the method of ball milling. A slurry was produced by combining 20 g PC-3 solid, 20 g of 10% polyvinyl pyrrolidone, and 160.0 g distilled water. To this mixture was added 475 ml of 1.8 mm zirconia beads. The slurry was ball milled for 72 hours. Following milling, the zirconia beads were removed by filtration.

PC-3

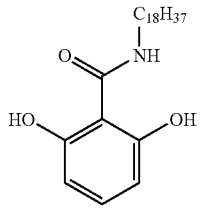

Magenta Coupler Dispersion, MCD-1:

A coupler dispersion was prepared by conventional means known in the art, containing magenta dye-forming coupler MC-1 at 5.5%, gelatin at 8.8%, tricresylphosphate at 4.4%, ethyl acetate at 0.47%, propionic acid at 0.13%, tris(1-methylethyl)-2-naphthalenesulfonic acid sodium salt at 0.13%, and 2-butoxy-N,N-dibutyl-5-(1,1,3,3-tetramethylbutyl)-benzenamine at 1.1%.

MC-1

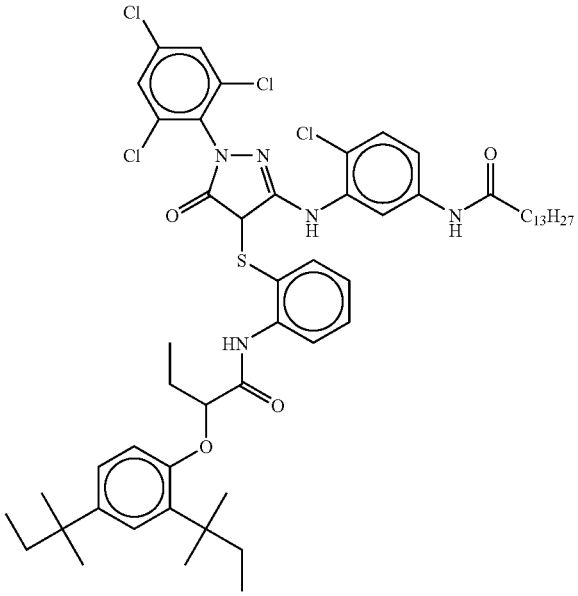

Comparative Example

The following aqueous multilayer coatings were prepared using a negative-working emulsion, using the materials in Table 1, according to methods known in the art. The support was 7 mil thick poly(ethylene terephthalate).

TABLE 1

| Component | $g/m^2$ |
|---|---|
| Layer 1: Imaging Layer | |
| Silver (from emulsion E-1) | 1.08 |
| Silver (from silver salt SS-1) | 0.48 |
| Silver (from silver salt SS-2) | 0.48 |
| Coupler MC-1 (from MCD-1) | 0.54 |
| Developer D-17 (from DD-1) | 0.65 |
| Salicylanilide (from TSD-1) | 0.86 |
| Gelatin | 4.31 |
| Layer 2: Overcoat | |
| Gelatin | 3.23 |
| Surfactant SF-1 | 0.01 |
| Surfactant SF-2 | 0.00 |
| Ethene, 1,1'-(methylenebis(sulfonyl))bis- | 0.14 |

Comparative Example 2

The following aqueous multilayer coatings were prepared using a negative working emulsion using the materials in Table 2, according to methods known in the art. The support was 7 mil thick poly(ethylene terephthalate).

TABLE 2

| Component | $g/m^2$ |
|---|---|
| Layer 1: Imaging Layer | |
| Silver (from emulsion E-1) | 1.08 |
| Silver (from silver salt SS-1) | 0.23 |
| Silver (from silver salt SS-2) | 0.18 |
| Coupler MC-1 (from MCD-1) | 0.54 |
| Developer D-17 (from DD-1) | 1.29 |
| Salicylanilide (from TSD-1) | 1.29 |
| Gelatin | 5.38 |
| Layer 2 Interlayer | |
| bis-vinylsulfonylmethane | 0.13 |
| citric acid | 0.00 |
| 3,5-dinitrobenzoic acid | 0.00 |
| copolymer of acrylamide and 2-methyl-2-[(1-oxo-2-propenyl)amino]-1-propanesulfonic acid, 80:20 m/m | 0.05 |
| Gelatin | 0.86 |
| Layer 3 Overcoat | |
| Gelatin | 0.86 |
| Poly-DimethylSiloxane | 0.02 |
| Ludox ® AM (colloidal silica) | 0.16 |
| Surfactant SF-1 | 0.01 |
| Surfactant SF-2 | 0.00 |

Comparative Example 3

The following aqueous multilayer coatings were prepared using a negative working emulsion using the materials in Table 3 below, according to methods known in the art. The support was 7 mil thick poly(ethylene terephthalate).

TABLE 3

| Component | $g/m^2$ |
|---|---|
| Layer 1: Imaging Layer | |
| Silver (from emulsion E-1) | 0.46 |
| Silver (from silver salt SS-1) | 0.46 |
| Silver (from silver salt SS-2) | 0.46 |

TABLE 3-continued

| Component | g/m$^2$ |
|---|---|
| Coupler MC-1 (from MCD-1) | 1.12 |
| Developer D-17 (from DD-1) | 0.34 |
| Salicylanilide (from TSD-1) | 0.86 |
| Succinimide | 0.22 |
| Phthalazine | 0.07 |
| Gelatin | 3.77 |

Comparative Example 4

The following aqueous multilayer coatings were prepared using a negative working emulsion using the materials in Table 4 below, according to methods known in the art. The support was 7 mil thick poly(ethylene terephthalate).

TABLE 4

| Component | g/m$^2$ |
|---|---|
| Layer 1: Imaging Layer | |
| Silver (from emulsion E-1) | 0.46 |
| Silver (from silver salt SS-1) | 0.54 |
| Silver (from silver salt SS-2) | 0.54 |
| Coupler MC-1 (from MCD-1) | 1.12 |
| Developer D-17 (from DD-1) | 1.12 |
| Salicylanilide (from TSD-1) | 0.86 |
| Succinimide | 0.22 |
| Phthalazine | 0.07 |
| Gelatin | 3.77 |

Example 5

Example 5 in accordance with the invention was prepared similar to Comparative Example 1 using coupler RC-1 dispersed as RCD-1, using the materials in Table 5.

TABLE 5

| Component | g/m$^2$ |
|---|---|
| Layer 1: Imaging Layer | |
| Silver (from emulsion E-1) | 1.08 |
| Silver (from silver salt SS-1) | 0.48 |
| Silver (from silver salt SS-2) | 0.48 |
| Coupler PC-2 (from PCD-3) | 0.81 |
| Developer D-17 (from DD-1) | 0.65 |
| Salicylanilide (from TSD-1) | 0.86 |
| Gelatin | 4.31 |
| Layer 2: Overcoat | |
| Gelatin | 3.23 |
| SF-1 | 0.01 |
| SF-2 | 0.00 |
| Ethene, 1,1'-(methylenebis(sulfonyl))bis- | 0.14 |

Example 6

Example 6 of the invention was prepared similar to Invention Example 1 using material RC-2 dispersed as RCD-2, using the materials in Table 6 below.

TABLE 6

| Component | g/m$^2$ |
|---|---|
| Layer 1: Imaging Layer | |
| Silver (from emulsion E-1) | 1.08 |
| Silver (from silver salt SS-1) | 0.48 |
| Silver (from silver salt SS-2) | 0.48 |
| Coupler PC-3 (from PCD-4) | 0.96 |
| Developer D-17 (from DD-1) | 0.65 |
| Salicylanilide (from TSD-1) | 0.86 |
| Ethanesulfonic acid, 2-(2-(2-(4-(1,1,3,3-tetramethylbutyl)phenoxy)ethoxy)ethoxy)-, sodium salt | 0.06 |
| Gelatin | 4.31 |
| Layer 2: Overcoat | |
| Gelatin | 3.23 |
| SF-1 | 0.01 |
| SF-2 | 0.00 |
| Ethene, 1,1'-(methylenebis(sulfonyl))bis- | 0.14 |

Example 7

Example 7 according to the invention was prepared as Comparative Example 3, except coupler MC-1 was replaced with coupler CC-1, using the materials in Table 7 below.

TABLE 7

| Component | g/m$^2$ |
|---|---|
| Layer 1: Imaging Layer | |
| Silver (from emulsion E-1) | 0.46 |
| Silver (from silver salt SS-1) | 0.46 |
| Silver (from silver salt SS-2) | 0.46 |
| Phenolic Coupler PC-1 (from PCD-1) | 1.12 |
| Developer D-17 (from DD-1) | 0.34 |
| Salicylanilide (from TSD-1) | 0.86 |
| Succinimide | 0.22 |
| Phthalazine | 0.07 |
| Gelatin | 3.77 |

Example 8

Example 8 in accordance with the present invention was prepared as Comparative Example 4, except coupler MC-1 was replaced with coupler CC-1 using the materials in Table 8.

TABLE 8

| Component | g/m$^2$ |
|---|---|
| Layer 1: Imaging Layer | |
| Silver (from emulsion E-1) | 0.46 |
| Silver (from silver salt SS-1) | 0.54 |
| Silver (from silver salt SS-2) | 0.54 |
| Phenolic Coupler PC-1 (from PCD-2) | 1.12 |
| Developer D-17 (from DD-1) | 1.12 |
| Salicylanilide (from TSD-1) | 0.86 |
| Succinimide | 0.22 |
| Phthalazine | 0.07 |
| Gelatin | 3.77 |

Example 9

The above described coatings were exposed $10^{-2}$ sec through a step wedge using a 3.05 log lux white light source at 5500K filtered by W2B and W99 filters. Alternatively, an EG+G light source was used, exposure time $10^4$ sec, filtered by a W99 and 2.0 ND. After exposure, the coating was thermally processed emulsion side to a heated surface for 10–35 seconds. A number of strips were processed at a variety of temperatures and times in order to yield an optimum strip process condition.

The density at highest exposure, $D_H$, was compared to the density formed at no exposure, $D_L$. A positive image is indicated by $D_L-D_H>0$, and a negative image by $D_L-D_H<0$. The invention examples developed to a positive image with good density discrimination.

TABLE 9

| | Density at Highest Exposure, $D_H$ | Density at Lowest Exposure, $D_L$ | $D_L - D_H$ | Comment |
|---|---|---|---|---|
| Comparative Ex. 1 | 1.52 | 1.20 | −0.32 | Magenta coupler, Green density, negative image |
| Comparative Ex. 2 | 2.16 | 0.98 | −1.18 | Magenta coupler, Green density, negative image |
| Comparative Ex. 3 | 1.39 | 1.21 | −0.18 | Magenta coupler, Green density, negative image |
| Comparative Ex. 4 | 1.15 | 0.83 | −0.32 | Magenta coupler, Green density, negative image |
| Ex. 5 | 0.82 | 1.46 | 0.64 | Black coupler, Blue density, positive image |
| Ex. 6 | 0.94 | 2.97 | 2.03 | Black coupler, Blue density, positive image |
| Ex. 7 | 0.58 | 0.49 | 0.09 | Cyan coupler, Red density, Positive image |
| Ex. 8 | 1.27 | 2.83 | 1.56 | Cyan coupler, Red density, Positive image |

Example 10

This Example illustrates the high photographic speed of an imaging element according to the present invention.

Preparation of Silver Bromoiodide Emulsion E-2:

Emulsion E-2 is a silver bromoiodide emulsion containing tabular grains having a mean equivalent circular diameter of 4.1 μm and a mean thickness of 0.135 μm. The emulsion was optimally chemically sensitized with sulfur and gold and spectrally pan-sensitized using known methods in the art with sensitizing dyes GSD-2, GSD-3 and GSD-4 in the relative amounts listed in Table 10.

TABLE 10

GSD-2 (0.184 g/mol silver)

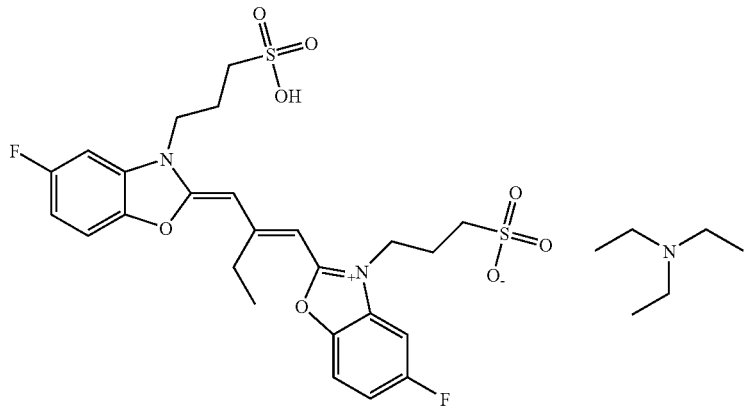

TABLE 10-continued

GSD-3 (0.200 g/mol silver)

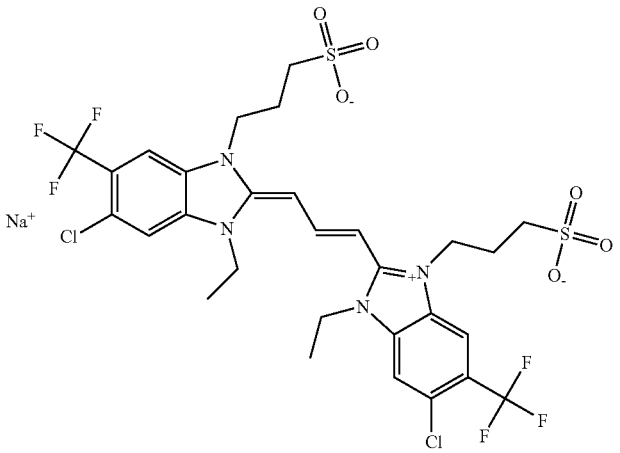

GSD-4 (0.246 g/mol silver)

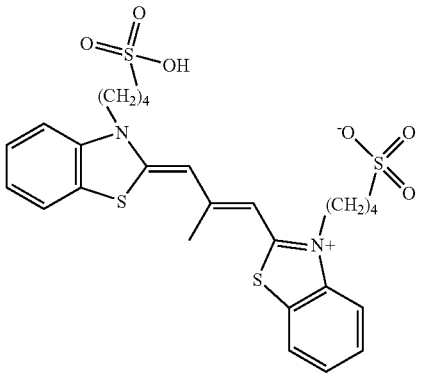

Coating Example 10 was prepared according to Comparative Example 4 having the composition listed in Table 11.

TABLE 11

| Component | g/m$^2$ |
|---|---|
| Layer 1: Imaging Layer | |
| Pansensitized Silver (from emulsion E-2) | 1.614 |
| Silver (from silver salt SS-1) | 0.46 |
| Silver (from silver salt SS-2) | 0.46 |
| Phenolic Coupler PC-3 (from PCD-4) | 1.12 |
| Developer D-17 (from DD-1) | 0.34 |
| Salicylanilide (from TSD-1) | 0.86 |
| Succinimide | 0.22 |

Coating Example 10 was exposed in a 4×5 Speed Graphic camera under Studio light conditions with only 2 fluorescent lights as the light source. To get a normally exposed print, the commercially available Polaroid 400 speed film required an exposure of 0.25 seconds at F/11.0.

The experimental photothermographic coating Example 10 required an exposure of only 0.008 seconds at F/11.0 to yield a high quality print after heat processing for 30 seconds at 160° C. The processed film image was scanned and printed on a Kodak 8600 Thermal Printer. This translates to an effective ISO speed of about 12,000, or 5 stops higher in photographic speed than the Polaroid 400 film.

Prints of reasonable but lesser quality could also be obtained from the experimental photographic film with the exposures of 0.008 seconds at F/16.0 under identical light conditions (ISO 20,000).

Example 11

This Example shows the time of development effect for an element according to the present invention.

Phenolic Coupler Dispersion PCD-5:

A dispersion of catechol PC-4 was prepared by the method of ball milling. A slurry was produced by combining 20 g PC-4 solid, 17.5 g of 10% polyvinyl pyrrolidone, 2.5 g of 9.14% Pionin® A44SP surfactant, and 162.5 g distilled water. To this mixture was added 475 ml of 1.8 mm zirconia beads. The slurry was ball milled for 72 hours. Following milling, the zirconia beads were removed by filtration.

PC-4

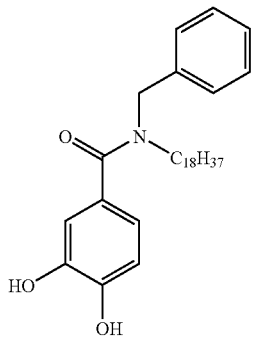

Example 12

An aqueous multilayer coating was prepared using a negative working blue light sensitive silver bromoiodide emulsion E-3 prepared according to methods known in the art. The support was 7 mil thick poly(ethylene terephthalate). The components in each layer are listed in Table 12.

TABLE 12

| Component | g/m$^2$ |
|---|---|
| Layer 1: Imaging Layer | |
| Blue sensitive silver (from E-3) | 3.23 |
| Silver (from silver salt SS-1) | 1.08 |
| Silver (from silver salt SS-2) | 1.08 |
| Catechol PC-4 (from PCD-5) | 1.08 |
| Developer D-17 (from DD-1) | 1.08 |
| Salicylanilide (from TSD-1) | 2.16 |
| Gelatin | 5.11 |
| Bis-vinylsulfonylmethane | 0.15 |
| Layer 3: Overcoat | |
| Gelatin | 1.61 |
| Ludox ® AM (colloidal silica) | 0.16 |
| Surfactant SF-1 | .05 |

Figure 2:
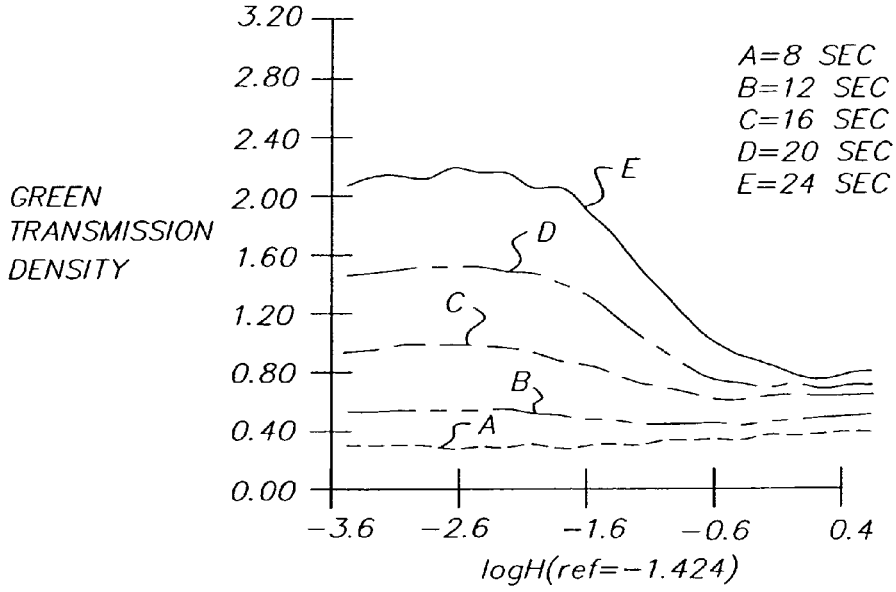
FIG. 2 is a graph (green transmission density) showing the effect of development time on the photographic H&D curve for one embodiment of a photographic film according to the present invention as described in Example 11 below.
Figure 3:
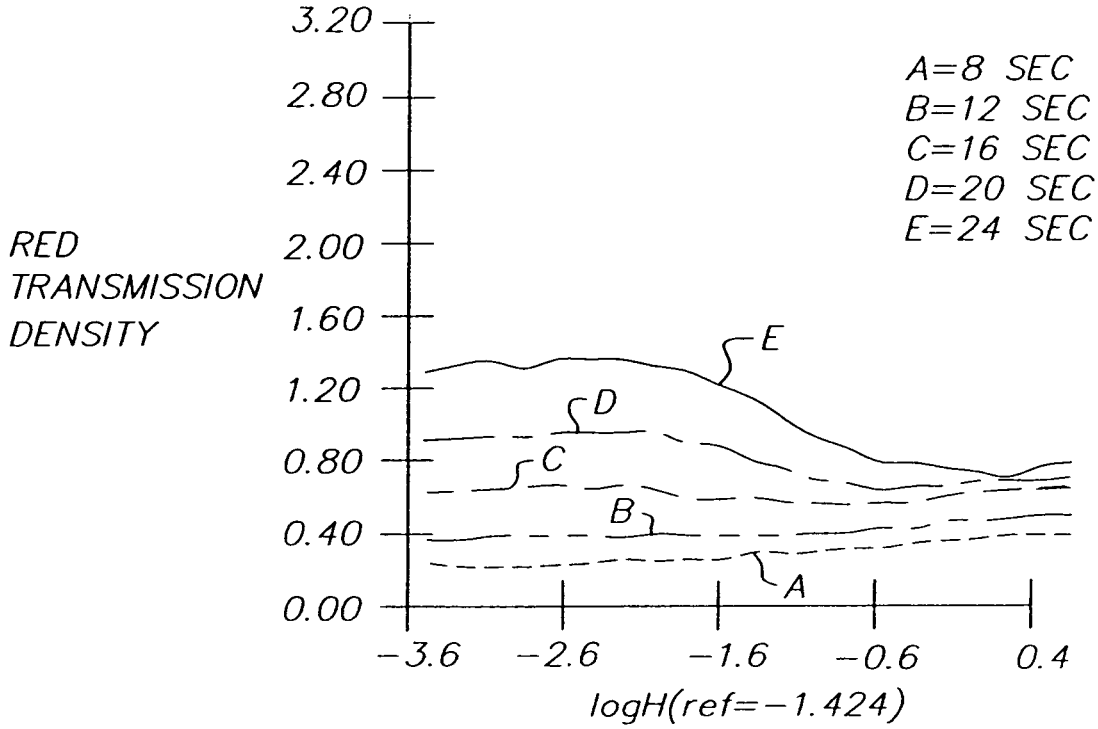
FIG. 3 is a graph (red transmission density) showing the effect of development time on the photographic H&D curve for one embodiment of a photographic film according to the present invention as described in Example 11 below.

Samples of Coating Example 11 were exposed $10^{-2}$ sec through a step wedge using a 3.05 log lux white light source at 5500K filtered by a 1.0 neutral density filter. The coatings were processed at 164° C. for 8, 12, 16, 20 and 24 seconds corresponding to A–E in FIGS. 1–3. Images had a dark brown Dmax and neutral Dmin. The effect of development time on the photographic H&D curve, wherein logH is the log of exposure H and wherein D is density, is shown in FIG. 1 (blue transmission density), FIG. 2 (green transmission density), and FIG. 3 (red transmission density). FIG. 1 shows a positive image with the highest density and discrimination at 24 second development time compared to the curves in FIGS. 2 and 3.

The invention has been described in detail with particular reference to preferred embodiments, but it will be understood that variations and modifications can be effected within the spirit and scope of the invention.

What is claimed is:

1. A method of forming a positive image in a photothermographic element that has been imagewise exposed to form a latent image, which element has at least one imaging layer comprising a potentially negative-working emulsion, said method comprising imagewise exposing said element and thermally developing the imagewise exposed element to produce a positive image in said imaging layer, wherein at the temperature of thermal development substantial imagewise inhibition occurs with respect to the exposed areas of the positive image relative to the unexposed areas of the positive image, wherein thermal development of unexposed silver grains in the exposed areas is inhibited relative to the unexposed areas and wherein negative image development is inhibited, wherein the imaging layer comprises at least two organic non-halide silver compounds, a first and a second organic non-halide silver compound, wherein a density-inhibiting agent is released by at least one of the organic non-halide silver compounds, and wherein the second organic non-halide silver compound that releases a density-inhibiting agent has a pKsp that is at least 0.5 greater than the pKsp of said first organic non-halide silver compound.

2. The method of claim 1, wherein the method further comprises the presence in the element of a developer or precursor thereof and an oxidized developer scavenging agent to accelerate development by removing oxidized developer as it is formed during the thermal development.

3. The method of claim 1 wherein the thermal development of unexposed silver salts in the exposed areas is inhibited relative to the unexposed areas by an effective amount of a density inhibitor that releases, during thermal development an inhibiting agent.

4. The method of claim 1 which method comprises imagewise exposing the photothermographic element with a non-solarizing amount of radiation or energy to form a latent image and completely developing the latent image to a positive image in a single thermal development unit step to produce a positive image in the element.

5. The method of claim 1, wherein the photothermographic element forms a positive image at high speed when exposed and heated 10 to 40 sec at 150 to 200° C., wherein the ISO speed is at least ISO 100 and as high as ISO 24000.

6. The method of claim 1 wherein the potentially negative-working emulsion comprises a silver-halide emulsion, in which silver-halide grains are spectrally sensitized to light wavelengths in the range 350 nm to 1500 nm, and at least one non-light-sensitive organic silver salt, said method comprising, following thermal development of the imagewise exposed element, forming imagewise reduced silver that is physically separate and morphologically distinct from the developed latent-image silver associated with the silver-halide grains.

7. The method of claim 1 comprising, following thermal development, the following steps:

scanning said developed positive image to form an analog electronic representation of said developed image;

digitizing said analog electronic representation to form a digital image;

digitally modifying said digital image; and storing transmitting, printing, or displaying said modified digital image.

8. The method of claim 1, wherein the element is a high speed black-and-white, monochrome, or bichrome film.

9. The method of claim 1 wherein the potentially negative-working emulsion comprises primarily tabular grains.

10. The method of claim 1 wherein the element is an x-ray film.

11. The method of claim 1 wherein the element a dental film.

12. The method of claim 1 wherein the clement is a dosimeter.

13. The method of claim 1 wherein following imagewise exposure and thermal development, the imagewise reduced silver, in the image forming layer, is physically separate and morphologically distinct from the developed latent image silver associated with the silver halide grains.

14. The method of claim 1 wherein the imaging layer further comprises a Dox scavenger and a developer or developer precursor, wherein upon thermal development, the ratio of the density produced in the unexposed area to the density produced in the highest exposed area, in the imaging layer, is greater then 1.1.

15. The method of claim 14 wherein the developer is an amine developer or precursor thereof.

16. The method of claim 14, wherein the density-inhibiting agent during thermal development inhibits development of unexposed silver particles in the exposed areas relative to the unexposed areas.

17. The method of claim 14, wherein thermal development results in a high-contrast positive image having a peak gamma greater than 1.0.

18. The method of claim 17, wherein the element is capable of forming a high-speed direct-positive image after full development that is at least two stops faster than said low-contrast thermally developed negative image.

19. The method of claim 1, wherein the second organic non-halide silver compound that releases a density-inhibiting agent comprises a mercapto-functional compound.

20. The method of claim 1, wherein the photothermographic element is conditioned in the dark at temperatures ranging from 30–110° C. and relative humidity levels ranging from 20–80% for 0–10 days prior to imagewise exposure.

21. The method of claim 1, wherein the first organic non-halide silver compound comprises a salt of a benzotriazole-functional compound.

22. The method of claim 1, wherein the first organic silver comprises silver benzotriazole and the second silver salt comprises silver 1-phenyl-5-mercaptotetrazole.

23. A method of processing a photothermographic element tat has been imagewise exposed, said element having at least one light-sensitive imaging layer comprising a potentially negative-working emulsion comprising light-sensitive silver halide, at least two organic non-halide silver compounds, a first and a second organic non-halide silver compound, wherein a density-inhibiting agent is released by at least one of the organic non-halide silver compounds, and wherein the second organic non-halide silver compound that releases a density-inhibiting agent has a pKsp that is at least 0.5 greater than the pKsp of said first organic non-halide silver compound, and an effective amount of a density inhibitor, which method in order comprises:

(a) thermally developing the clement without any externally applied developing agent, comprising heating said element to a temperature greater than 150° C. in an essentially dry process to form a positive image in the light-sensitive imaging layer of the photothermographic element, wherein at the temperature of thermal development substantial imagewise inhibition occurs with respect to the exposed areas of the positive image relative to the unexposed areas of the positive image, wherein thermal development of unexposed silver grains in the exposed areas is inhibited relative to the unexposed areas and wherein negative image development is inhibited; and scanning the positive image to provide a digital electronic record capable of generating a positive image in a display element.

24. The method of claim 23 wherein the method further comprises the presence in the element of a developing agent or precursor thereof and an effective amount of a Dox scavenger for removing oxidized developer as it is being formed during thermal development.

25. A method of forming a positive image in a photothermographic element that has been imagewise exposed to form a latent image, which element has at least one imaging layer comprising a potentially negative-working emulsion, said method comprising imagewise exposing said element and thermally developing the imagewise exposed element to produce a positive image in said imaging layer, wherein at the temperature of thermal development substantial imagewise inhibition occurs with respect to the exposed areas of the positive image relative to the unexposed areas of the positive image, wherein thermal development of unexposed silver grains in the exposed areas is inhibited relative to the unexposed areas and wherein negative image development is inhibited, and wherein the method further comprises the presence in the element of a developer or precursor thereof, an oxidized developer scavenging agent to remove oxidized developer as it is formed during the thermal development, light-sensitive silver halide, and wherein the imaging layer comprises at least two organic non-halide silver salts, a first and a second organic silver compound, wherein a density-inhibiting agent is released by at least one of the organic silver salts, wherein the second organic silver salt that releases a density-inhibiting agent has a pKsp that is at least 0.5 greater than the pKsp of said first organic silver salt, and wherein the second organic silver salt that releases a density-inhibiting agent comprises a mercapto-functional compound and the first organic silver salt comprises a salt of a benzotriazole-functional compound.

26. The method of claim 25, wherein the method of claim 1, wherein the oxidized developer scavenging agent used to remove oxidized developer as it is formed during the thermal development is a phenolic coupler.

27. The method of claim 25 wherein the unexposed areas rapidly develop to a high-density fog, whereas fog-density development in exposed areas of the image is imagewise inhibited during thermal development.

28. The method of claim 1 wherein to unexposed areas rapidly develop to a high-density fog, whereas fog-density development in exposed areas of the image is imagewise inhibited during thermal development.

29. The method of claim 23 wherein the unexposed areas rapidly develop to a high-density fog, whereas fog-density development in exposed areas of the image is imagewise inhibited during thermal development.

* * * * *